US007736195B1

(12) United States Patent
Poulsen et al.

(10) Patent No.: US 7,736,195 B1
(45) Date of Patent: Jun. 15, 2010

(54) CIRCUITS, SYSTEMS AND METHODS FOR IMPLEMENTING HIGH SPEED DATA COMMUNICATIONS CONNECTORS THAT PROVIDE FOR REDUCED MODAL ALIEN CROSSTALK IN COMMUNICATIONS SYSTEMS

(75) Inventors: Jeffrey Alan Poulsen, Edmonds, WA (US); Jason Erickson, Bothell, WA (US); Jeffrey P. Seefried, Lake Stevens, WA (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 12/401,587

(22) Filed: Mar. 10, 2009

(51) Int. Cl.
*H01R 24/00* (2006.01)

(52) U.S. Cl. ..... 439/676; 439/941

(58) Field of Classification Search ..... 439/676, 439/941

See application file for complete search history.

(56) References Cited

U.S. PATENT DOCUMENTS

| | | | | |
|---|---|---|---|---|
| 5,186,647 | A | 2/1993 | Denkmann et al. | |
| 5,299,956 | A | 4/1994 | Brownell et al. | |
| 5,791,943 | A | 8/1998 | Lo et al. | |
| 6,083,052 | A | 7/2000 | Adams et al. | |
| 6,139,371 | A | 10/2000 | Troutman et al. | |
| 6,186,834 | B1 | 2/2001 | Arnett et al. | |
| 6,379,157 | B1 | 4/2002 | Curry et al. | |
| 6,464,541 | B1 | 10/2002 | Hashim et al. | |
| 6,641,443 | B1 | 11/2003 | Itano et al. | |
| 6,786,776 | B2 | 9/2004 | Itano et al. | |
| 7,038,554 | B2 * | 5/2006 | Seefried | 333/24 C |
| 7,153,168 | B2 | 12/2006 | Caveney et al. | |

(Continued)

FOREIGN PATENT DOCUMENTS

JP 2000113941 A 4/2000

OTHER PUBLICATIONS

Korean Intellectual Property Office (ISA), International Search Report, International Application No. PCT/US2008/077138, Mar. 23, 2009.

(Continued)

*Primary Examiner*—Tho D Ta
(74) *Attorney, Agent, or Firm*—Kathryn J. Milam; Paul F. Rusyn; Graybeal Jackson LLP

(57) ABSTRACT

A communications outlet includes eight outlet tines positioned adjacent one another and defining four pairs of outlet tines. The fourth and fifth outlet tines define a first pair, the first and second outlet tines define a second pair, the third and sixth outlet tines define a third pair, and the seventh and eighth outlet tines define a fourth pair. Each outlet tine has a free end near to which a plug contact is adapted to touch and each outlet tine has a fixed end coupled through a corresponding conductive trace to a corresponding conductive wire termination contact. The communications outlet includes a first modal alien crosstalk compensation stage connected to the outlet tines associated with the second, third, and fourth pairs. The first modal alien crosstalk compensation stage includes independent capacitive components operably responsive to differential signals on the third pair to introduce common mode signals onto the second and fourth pairs that have the opposite polarity of common mode signals on the second and fourth pairs at points where the plug contacts connect with the outlet tines.

25 Claims, 17 Drawing Sheets

U.S. PATENT DOCUMENTS

| | | | |
|---|---|---|---|
| 7,179,131 | B2 | 2/2007 | Caveney et al. |
| 7,201,618 | B2 | 4/2007 | Ellis et al. |
| 7,204,722 | B2 | 4/2007 | Hashim et al. |
| 7,281,957 | B2 | 10/2007 | Caveney |
| 7,309,261 | B2 | 12/2007 | Caveney et al. |
| 7,357,683 | B2 | 4/2008 | Caveney et al. |
| 7,381,098 | B2 | 6/2008 | Hammond, Jr. et al. |
| 7,384,315 | B2 | 6/2008 | Caveney et al. |
| 2006/0189215 | A1 | 8/2006 | Ellis et al. |
| 2007/0173120 | A1 | 7/2007 | Caveney et al. |
| 2007/0270042 | A1 | 11/2007 | Belopolsky et al. |
| 2007/0270044 | A1 | 11/2007 | Belopolsky et al. |
| 2008/0045090 | A1 | 2/2008 | Caveney |
| 2009/0163084 | A1 | 6/2009 | Straka et al. |

OTHER PUBLICATIONS

Korean Intellectual Property Office (ISA), Written Opinion, International Application No. PCT/US2008/077138, Mar. 23, 2009.

Johnson, Howard W.; Graham, Martin, High-Speed Signal Propagation, Mar. 2003, ISBN 0-13-084408-X, ISBN-13: 9780130844088, 800 pp., 1st Edition, Pearson Education Inc., publishing as Prentice Hall Professional Technical Reference, Upper Saddle River, NJ 07458, USA.

U.S. Appl. No. 12/234,597, filed Sep. 19, 2008, Applicants: Franklin C. Marti et al.

International Application Serial No. PCT/US2008/077138, filed Sep. 19, 2008, Applicants: Franklin C. Marti et al.

* cited by examiner

CIRCUITS, SYSTEMS AND METHODS FOR IMPLEMENTING HIGH SPEED DATA COMMUNICATIONS CONNECTORS THAT PROVIDE FOR REDUCED MODAL ALIEN CROSSTALK IN COMMUNICATIONS SYSTEMS

TECHNICAL FIELD

The present invention relates generally to communications outlets and, more specifically, to circuits, systems, and methods for implementing these devices such that the level of modal alien crosstalk, typically present in communications networks in which these devices are used, is substantially reduced.

BACKGROUND

The speed of data communications networks has been increasing steadily and substantially over the past several decades, requiring newly designed components to enable the networks to operate at these new higher speeds. As the speed of networks increases, the frequency at which electrical signals in these networks are communicated increases, and physical wiring paths within the network, which presented no problems at lower frequencies, can become antennae that broadcast and receive electromagnetic radiation and cause errors in the data being communicated. This unwanted coupling of signals from one communication path to another is known as "crosstalk" and degrades the overall performance of the network. Unwanted crosstalk can occur between any proximate electrically conductive paths that physically form parts of the network, such as individual pairs of data signals within a given communications cable, between or among nearby communications cables, and within connectors used to connect cables to desired electronic components, such as routers and network switches, within the network.

FIG. 1 is a diagram illustrating a portion of a conventional communications network 100 including a typical communications channel 101. The channel 101 includes a communications outlet 102 into which a communications plug 104 of a cable 106 is inserted to thereby connect a computer system 108 to the communications network 100. The communications outlet 102 fits within an opening 110 of a wall plate 112 to expose an aperture 114 in the communications outlet into which the plug 104 is inserted. Electrical signals are then communicated to and from the computer system 108 through the cable 106, plug 104, outlet 102, and a cable 116. The cable 116 includes another communications outlet 118 on the other end of the cable, with the communications outlet 118 often being part of another network component such as a patch panel 120. A network switch 122 or other network component is connected to outlet 118 through a cable 124 and plug 126 to interconnect the communications channel 101 to other components in the network 100, as indicated by the arrow 127.

The cables 106 and 116, plug 104 and 126, and outlets 102 and 118 are standardized components that include specified numbers of electrically conductive components and arrangement of such components within the plugs and outlets. Where the system 100 utilizes the Ethernet communications standard, for example, data is communicated through four twisted-pairs of conductive wires in the cables 106, 116. The plugs 104, 126 and outlets 102, 118 likewise include four corresponding pairs of electrically conductive elements or paths, such as in RJ-45 outlet and plugs. For historical reasons, the physical arrangement of such electrically conductive components within the plugs 104 and 126 is such that unwanted crosstalk is generated between the pairs of such electrically conductive elements. The outlets 102, 118, are designed in such a manner as to nullify the crosstalk generated by the plugs. As the speed at which data is communicated increases, so does the frequency range of operation for all components of the communications channel 101, making nullification of the unwanted crosstalk more difficult to achieve for reasons understood by those skilled in the art. This arrangement of electrically conductive components for the plugs 104, 126 and outlets 102, 118 has nonetheless been retained even for current high-speed networks to provide compatibility between old and new network components.

As the speed or frequency at which networks operate continues to increase, crosstalk can become significant and can interfere with the proper operation of the network 100. There are generally two types of crosstalk. The first type of crosstalk occurs among the pairs of electrically conductive components within an individual communications channel 101 and is termed "internal crosstalk." Internal crosstalk is the unwanted signals communicated from one pair to another within a single channel.

The second type of crosstalk is known as "alien crosstalk" and occurs between pairs of electrically conductive components in different communications channels 101. Alien crosstalk can be defined as unwanted signals communicated between pairs in different channels. Alien crosstalk can occur between most components of communications networks 100, and is particularly significant between those components which are physically located proximate to each other. For example, assume that nearby the cables 106, 116, plugs 104, 126, and outlets 102, 118 of the communications channel 101 of FIG. 1, there are several additional similar communications channels having corresponding components. This would typically be the case in the network 100.

One particular type of alien crosstalk is known as "modal alien crosstalk" and is initiated by the unequal electrical exposures of some of the electrically conductive components within the plugs 104, 126 to other comparable electrically conductive components. These unequal electrical exposures result in a modal conversion of signals that causes unwanted electromagnetic waves of a different mode to propagate in a given communications channel 101. These unwanted electromagnetic waves of a different mode can cause crosstalk in adjacent communications channels 101 that can interfere with the proper operation of such channels, particularly at the ever increasing frequencies at which networks operate. Since the outlets 102, 118 have conductors similarly arranged to those of the plug 104, 126 to be mechanically compatible, both the outlets and the plugs in a given channel cause modal conversion of signals. In addition, compensation circuitry used in the outlet to neutralize internal crosstalk can further add to the modal conversion of signals. Thus, both plugs and outlets contribute to the generation of modal alien crosstalk.

There is a need for improved communications outlets designed to neutralize the modal conversion of signals initiated in the plug, and reduce that generated in the outlet itself, without significantly increasing the complexity of manufacturing the outlet or its cost.

SUMMARY

According to one aspect of the present invention, a communications outlet includes eight conductive paths, each conductive path including a spring type electrical contact referred to herein as an outlet tine. The eight outlet tines are positioned adjacent one another and define four pairs of outlet tines. The fourth and fifth outlet tines define a first pair, the first and second outlet tines define a second pair, the third and sixth outlet tines define a third pair, and the seventh and eighth outlet tines define a fourth pair. Each outlet tine has a free end adapted to touch a plug contact as well as a fixed end secured to a printed circuit board and coupled through a corresponding conductive trace to a corresponding electrically conductive element designed to electrically couple outlet tines to electrically conductive elements in cable terminated thereto and referred to herein as "wire termination contacts." An insulation displacement contact (IDC) is often used as a preferred embodiment of the wire termination contact and the terms may be used interchangeably. Of course, any other means of electrically coupling outlet tines to electrically conductive elements in cable, such a soldering, may be used.

The communications outlet includes a first modal alien crosstalk compensation stage that can be located on or near the outlet tines corresponding to the second, third, and fourth pairs. The first modal alien crosstalk compensation stage includes independent capacitive components operably responsive to differential signals on the third pair to introduce common mode signals onto the second and fourth pairs that are opposite in polarity to the common mode signal generated in the mated plug and on the tines in the outlet on these pairs, that may be at a location as close as physically possible to the points where the plug contacts touch the outlet tines.

According to another aspect of the invention, a second stage of modal compensation is employed. The second stage of modal compensation is applied between the conductive traces and the wire termination contacts that are associated with the tines. The second stage is similar to the first stage except that the compensating signal is now opposite in polarity to that applied in the first stage. In addition, the second stage is applied at a location that is electrically delayed from the first stage. The addition of the second stage of modal compensation causes a reduction in modal crosstalk at the higher frequencies shown to be the frequency range of most concern for modal alien crosstalk.

DETAILED DESCRIPTION

Figure 2:
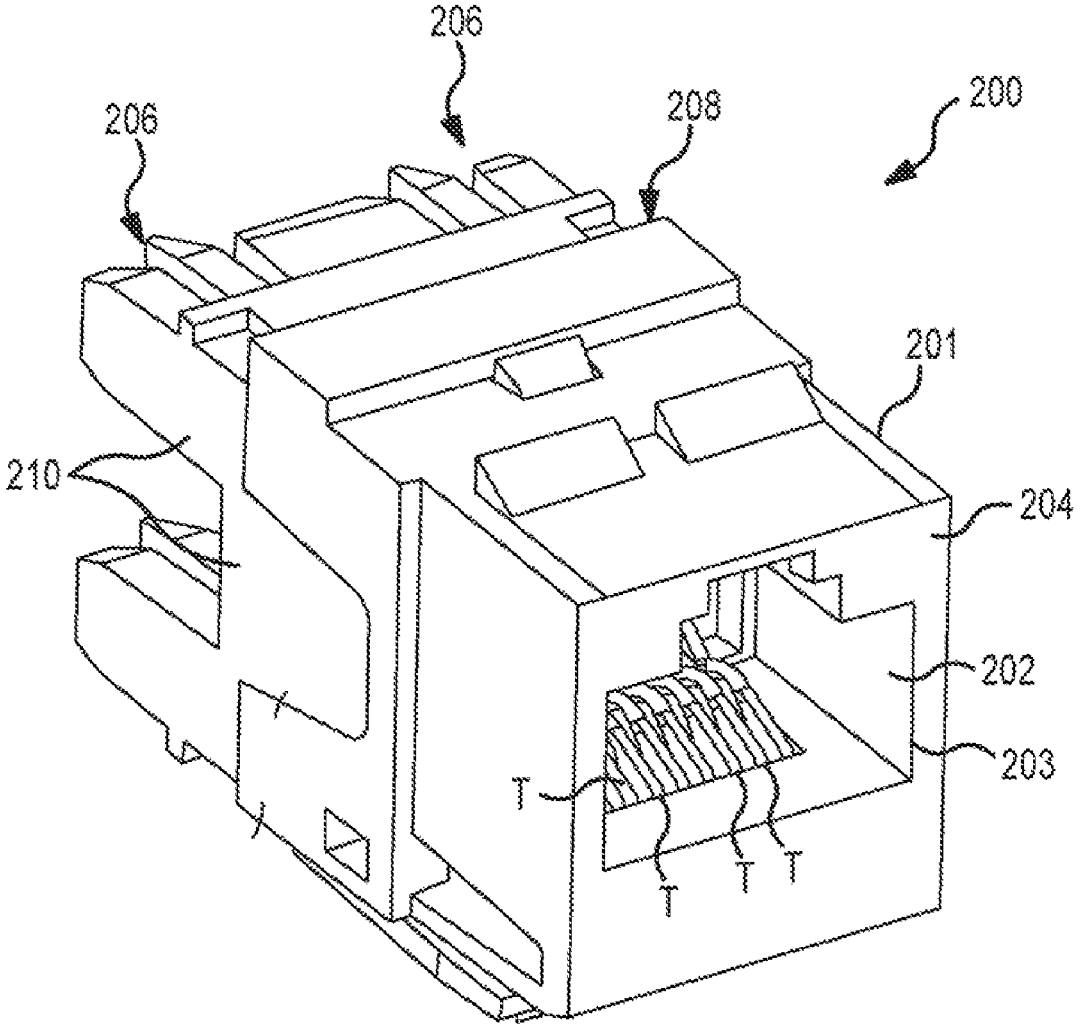
FIG. 2 is a more detailed perspective view of a communications outlet including a first modal alien crosstalk compensation stage according to one embodiment of the present invention.
Figure 3:
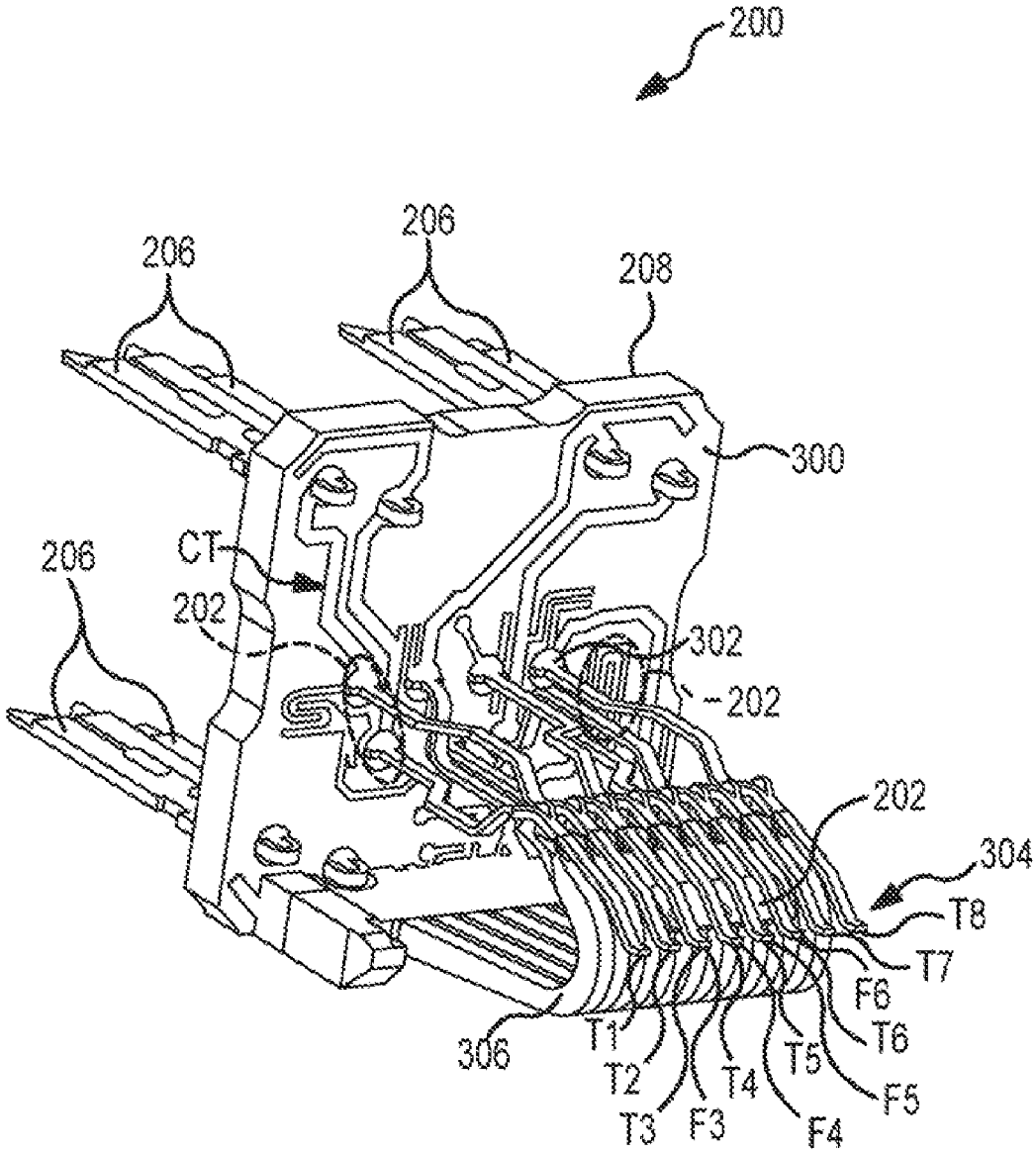
FIG. 3 is a perspective view of the communications outlet of FIG. 2 with the body removed to show in more detail possible locations of the first modal alien crosstalk compensation stage according to embodiments of the present invention.

FIGS. 2 and 3 are perspective views of a communications outlet 200 including a first modal alien crosstalk compensation stage 202 according to one embodiment of the present invention. In operation, the first modal alien crosstalk compensation stage 202 nullifies the common mode signals that are generated in the mated plug-outlet combination that are the causes of modal alien crosstalk. It also reduces the susceptibility of the outlet to modal alien crosstalk from nearby network components (not shown), as will be described in more detail below. The term "mated plug-outlet combination" is utilized to mean an outlet with a plug inserted into that outlet.

The inclusion of the first modal alien crosstalk compensation stage 202 enables existing outlet structures to function satisfactorily at high frequencies, such as those required for category 6 (CAT6) and category 6A (CAT6A) outlets, without requiring significant changes to be made to the mechanical structure of the existing outlets. While more complicated mechanical structures involving rearranging the contacts within the outlet 200 can be utilized to reduce modal alien crosstalk, such structures increase the expense and complexity of manufacturing the outlet. With the outlet 200, no such modifications to existing mechanical structures are required.

Figure 1:
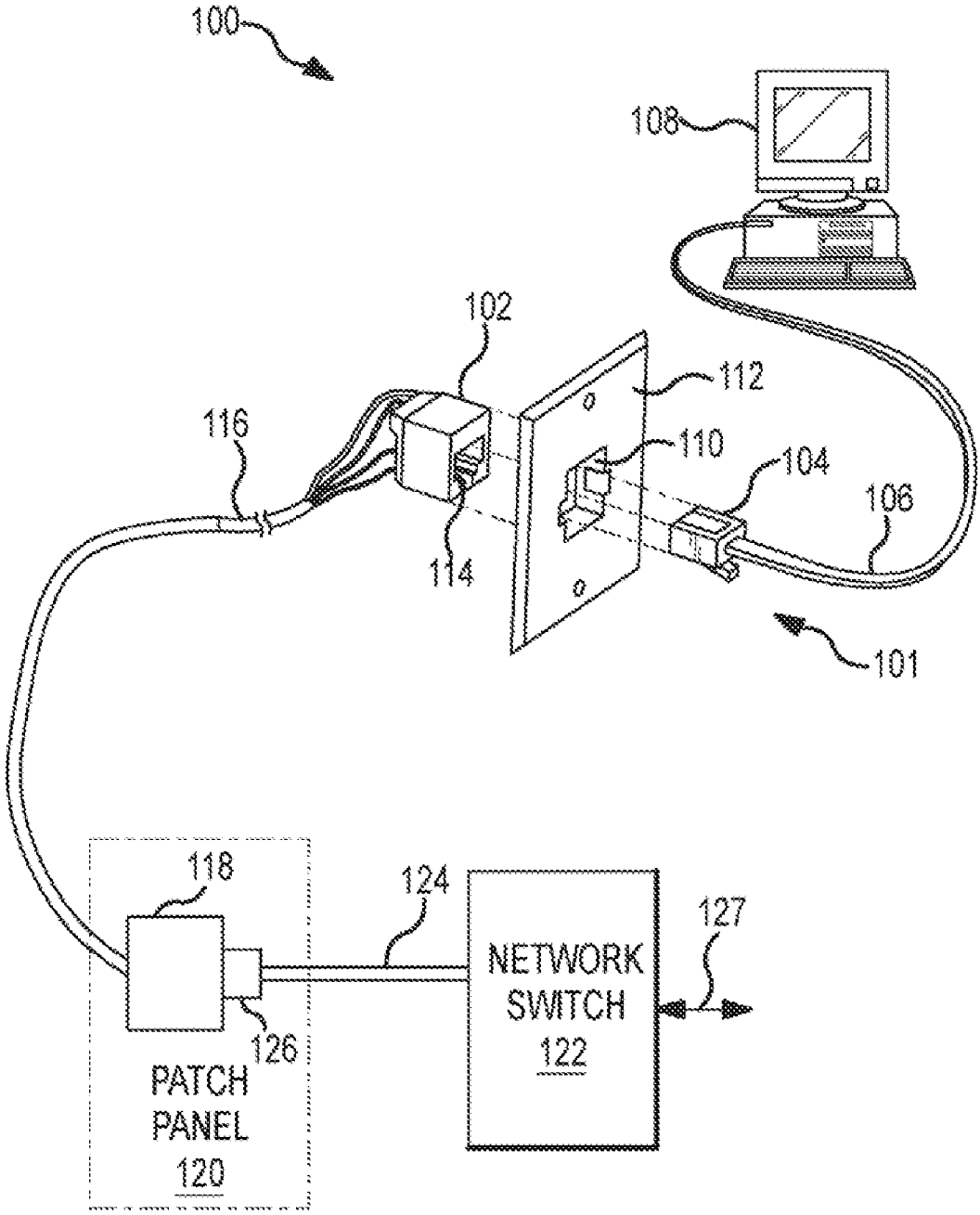
FIG. 1 (BACKGROUND ART)
FIG. 1 is a diagram illustrating a portion of a conventional communications network including a communications outlet.

Referring to FIG. 2, the outlet 200 includes an insulating housing or body 201 and a plurality of spring type or resilient conductive outlet tines T1-T8 in parallel arrangement within an interior receptacle 203 of the body. Also note that in the present description, when referring generally to any one of a number of similar components, such as the tines T1-T8, the number designation may be omitted, and when referring to a specific one of the components, such as tine T4, the number designation will be included. The receptacle 203 is formed in a front 204 of the body 201 and the outlet tines T1-T8 within the receptacle are connected to wire termination contacts 206 (not shown) situated within a termination block 210 at a back 208 of the body. Wires within a cable (not shown) of a communications channel, such as the channel 101 of FIG. 1, are then connected to the wire termination contacts 206, or otherwise electrically coupled, as will be appreciated by those skilled in the art.

FIG. 3 is a perspective view of the communications outlet 200 of FIG. 2 with the body 201 removed to show in more detail the inner structure of the outlet and the first modal alien crosstalk compensation stage 202 according to one embodiment of the present invention. The outlet 200 includes a rigid printed circuit board 300 with the wire termination contacts 206 attached to the printed circuit board and each of a number of outlet tines T1-T8 including a fixed end 302 that is also attached to the printed circuit board. Conductive traces CT1-CT8, which are designated generally as simply CT in the figure, are formed on the printed circuit board 300 and interconnect the wire termination contacts 206 and fixed ends 302 of the tines T. The tines T1-T8 include free ends 304 positioned proximate the front 204 (FIG. 2) of the outlet 200. The outlet 200 further includes nonconductive and resilient spring arms 306 positioned under the tines T1-T8 to support the tines.

FIG. 3 illustrates two embodiments of the outlet 200. In a first embodiment, the first modal alien crosstalk compensation stage 202 is formed on a flexible printed circuit board that is attached to the underside of tines T3-T6 through conductive fingers F3-F6, respectively. The conductive fingers F3-F6 are part of the flexible printed circuit board of the first modal alien crosstalk compensation stage 202. In a second embodiment, the first modal alien crosstalk compensation stage 202 is formed on the rigid printed circuit board 300, as is also illustrated through the dotted lead lines in FIG. 3. Both embodiments will be discussed in more detail below.

Figure 4:
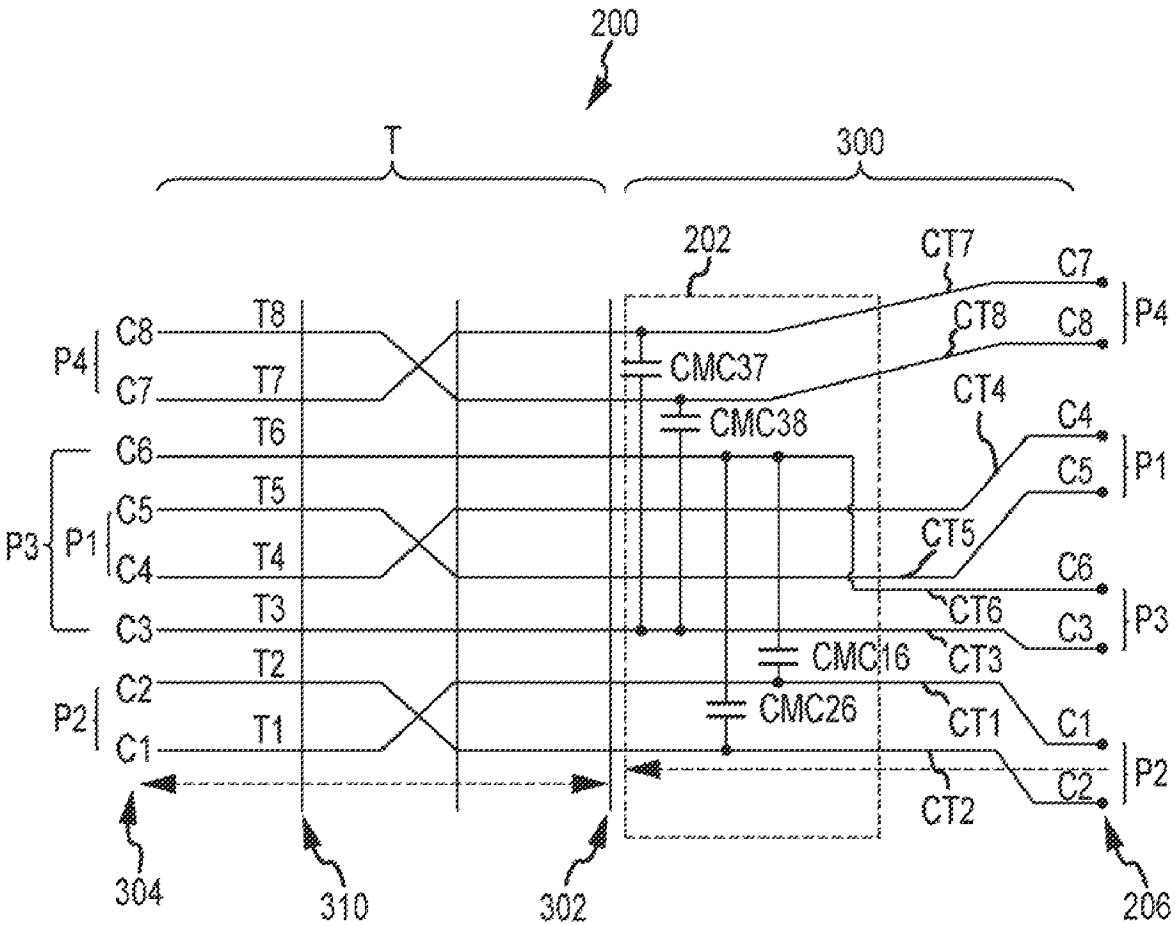
FIG. 4 is a schematic of the communications outlet of FIGS. 2 and 3 including the first modal alien crosstalk compensation stage for reducing modal alien crosstalk according to one embodiment of the present invention.

Referring now to FIG. 4, this figure is a schematic of the communications outlet 200 including the first modal alien crosstalk compensation stage 202 for reducing modal alien crosstalk within the communications outlet according to one embodiment of the present invention. Before discussing the first modal alien crosstalk compensation stage 202 in more detail, the schematic will first be discussed more generally and certain terms associated with the outlet 200 will be defined. The outlet 200 includes eight conductive paths or conductors C1-C8. Each of the eight conductors C1-C8 represents the corresponding conductive outlet tine T1-T8, conductive traces CT1-CT8 on the rigid printed circuit board 300, and wire termination contacts 206. The eight conductors C1-C8 form four signal pairs P1-P4, with conductors C4 and C5 being pair P1, conductors C1 and C2 being pair P2, conductors C7 and C8 being pair P4, and conductors C3 and C6 being pair P3. Each pair P1-P4 of conductors C1-C8 carries a corresponding electrical signal, as will be appreciated by those skilled in the art. Note that although the outlet 200 is shown and will be described as including wire termination contacts 206 on the far right of FIG. 4, the far right ends of each conductor C1-C8 more generally represent the points where a wire of a communications cable (not shown) connects to the conductor. Thus, although these are described herein as being wire termination contacts 206, one skilled in the art will appreciate that other types of conductive contacts could also be utilized, such as terminals, bonding pads, soldering, vias or through holes, and so on. The term wire termination contact is used herein to refer generally to all such types of conductive contacts.

Thus, in FIG. 4, portions of the conductors C1-C8 on the left side of the figure correspond to the outlet tines T1-T8 in the outlet 200 (FIG. 3) that extend from the free ends 304 of the outlet tines on the far left to the fixed ends 302 of the outlet tines toward the middle of the figure. The portions of conductors C1-C8 on the right side of the figure represent the conductive traces CT1-CT8 and the wire termination contacts 206 that are situated at the back 208 (FIG. 3) of the outlet 200. In FIG. 4, the conductors C1 and C2 of pair P2, C4 and C5 of pair P1, and C7 and C8 of pair P4 "crossover" towards the front of the outlet 200, which is to the left side of FIG. 4. More specifically, the tines T1 and T2 of pair P2, T4 and T5 of pair P1, and T7 and T8 of pair P4 "crossover." These crossovers of pairs P1, P2, and P4 reduce internal crosstalk within the outlet 200, where "internal crosstalk" is the crosstalk that occurs among the pairs P1-P4 of conductors C1-C8 within an individual outlet and communications channel 101 (FIG. 1), as previously discussed.

The first modal alien crosstalk compensation stage 202 includes a number of independent modal capacitive elements CMC that function to introduce common mode signals onto the second and fourth pairs P2 and P4 of outlet tines T and/or their associated circuit paths. Note that in the embodiment of the outlet 200 illustrated through the schematic of FIG. 4, the independent modal capacitive elements are shown as being formed on the rigid printed circuit board 300 previously described with reference to FIG. 3. In another embodiment, the first modal alien crosstalk compensation stage 202, and corresponding capacitive elements CMC which are formed on a flexible printed circuit board attached to the tines T, is depicted in FIG. 3. This second embodiment will be described in more detail below with reference to FIGS. 8A and 8B.

In the embodiment of the outlet 200 illustrated through the schematic of FIG. 4, the first modal alien crosstalk compensation stage 202 includes four modal capacitors CMC37, CMC38, CMC16, and CMC26 formed on the rigid printed circuit board 300 of the outlet 200. The inclusion of the first modal alien crosstalk compensation stage 202 enables existing outlet structures to function satisfactorily at high frequencies, such as those required for CAT6 and CAT6A outlets, without requiring significant changes to the mechanical structure of the existing outlets. For example, no structural changes need be made to tines T3 and T6. Such changes, while they could be made to existing outlets to provide desired modal alien crosstalk compensation, complicate the mechanical structure of the outlet. A more complicated mechanical structure would typically make the outlet more expensive to manufacture, less reliable, and reduce the usable life of the outlet.

Figure 5:
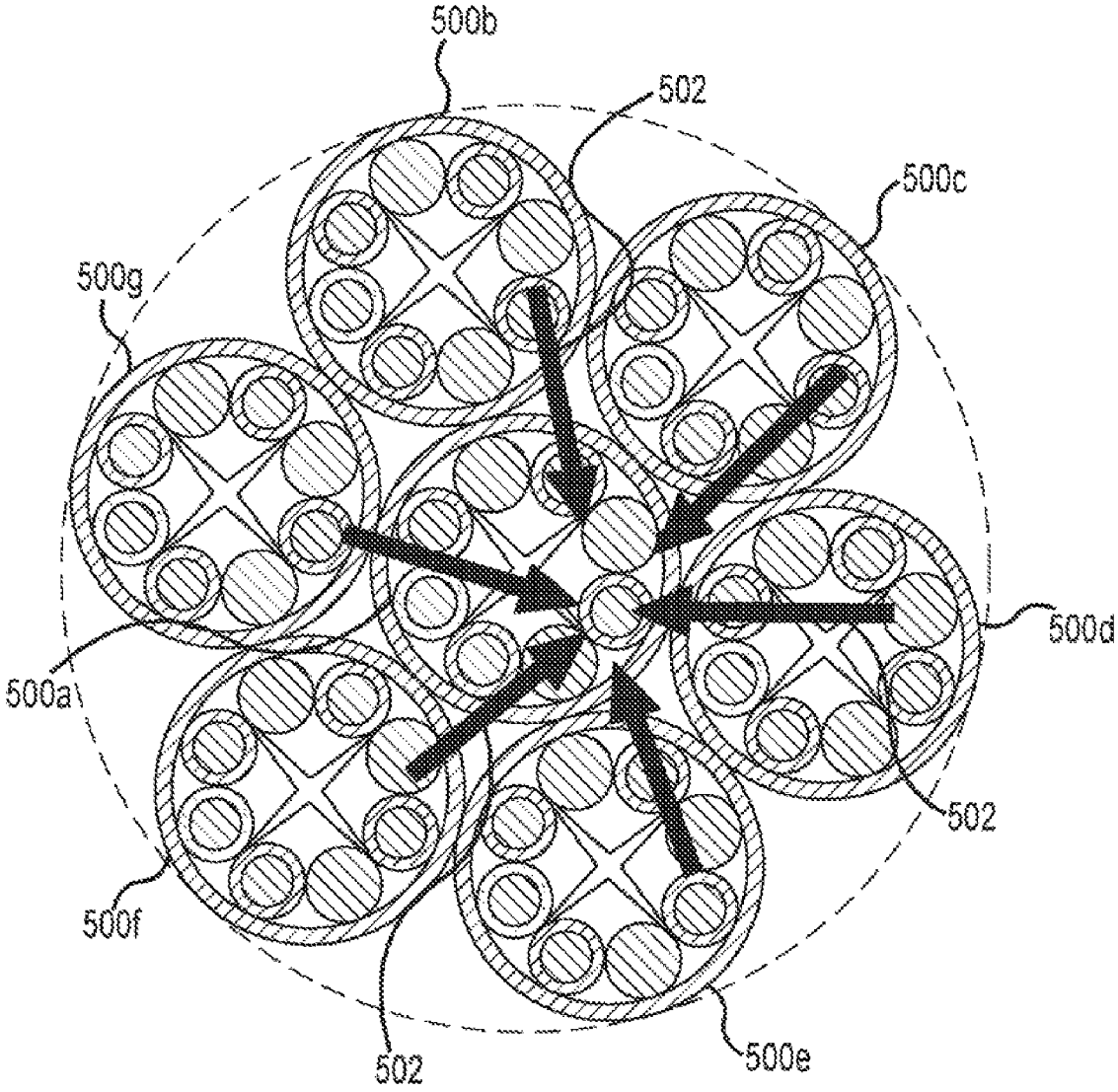
FIG. 5 is a cross-sectional view of several adjacent communications channel cables that illustrates the phenomenon of alien crosstalk.

Before describing the operation of the first modal alien crosstalk compensation stage 202 in more detail, the concepts of alien crosstalk and modal alien crosstalk will first be described in more detail with reference to FIGS. 5 and 6. FIG. 5 is a cross-sectional view of a bundle including several cables 500*a-g* contained in adjacent communications channels 101 (FIG. 1) that illustrates generally the phenomenon of alien crosstalk. Each cable 500*a-g* corresponds to a cable in a corresponding communications channel 101, such as one of the cables 106, 116 in the communications channel 101 of FIG. 1. In the illustrated example, the centermost cable 500*a* is the victim cable and is surrounded by the cables 500*b-g*. Each cable 500 has four pairs of conductors as represented by the smaller circles within each cross section. As a result, the four pairs in the cables 500*b-g* surrounding the four pairs in the victim cable 500*a* can be significant sources of alien crosstalk in the pairs of the victim cable. This alien crosstalk is represented by arrows 502 in FIG. 5. Some of the outlets 118 in the patch panel 120 of FIG. 1, and the cables 116 connecting to these outlets, could have an arrangement very similar to the cables 500 of FIG. 5 in terms of the relative positions of the conductors in the adjacent outlets. In this situation, at least some of the outlets 118 in the patch panel 120 would be susceptible to alien crosstalk.

Two common forms of alien crosstalk are alien near end cross talk (ANEXT) and alien far end cross talk (AFEXT). These terms refer to crosstalk between a first pair in a first communication cable and a second pair in an adjacent cable. When measuring the crosstalk of all adjacent cable pairs onto a pair in a victim cable (e.g., cable pairs 400*b*-*g* onto a pair in victim cable 400*a*), power sum alien near end crosstalk (PSANEXT) and power sum far end alien crosstalk (PSAFEXT) are calculated, as will be appreciated by those skilled in the art. To account for the attenuation of the cable associated with the AFEXT measurement, the PSAFEXT calculation includes the attenuation term and is called power sum alien attenuation to crosstalk ratio-far end (PSAACR-F), as will also be understood by those skilled in the art.

Modal alien crosstalk can also occur between elements of communications channels located physically nearby. At the high frequency signals being communicated in current outlets, such as up to 500 MHz for outlets meeting the CAT6A communications standard, the asymmetrical electrical exposure caused by conductors C3 and C6 of pair P3 as illustrated in FIG. 4 results in both increased internal crosstalk within the outlet 200 and increased modal alien crosstalk with adjacent outlets. This internal crosstalk is most prevalent between pairs P1 and P3 due to the separation or "splitting" of the conductors C3 and C6 of pair 3, with pair P3 commonly being referred to as the "split pair." The reasons for the presence of the split pair (i.e., using conductors C3 and C6 as pair P3) are historical and current outlets maintain this configuration for compatibility reasons.

The origin of unanticipated and unwanted modal alien crosstalk is the modal conversion of signals that occurs within the plug and outlet 200 as a result of the unequal electrical exposure of conductors such as the plugs 104 and 126 and outlets 102 and 118 of FIG. 1. Since the outlet 200 and corresponding plug have similarly arranged conductors to be compatible, the outlet and plug cause similar modal conversion of signals and thus both contribute to the generation of modal alien crosstalk.

The unequal electrical exposures of the conductors C3 and C6 of pair P3 will now be described in more detail. Due to the physical proximity of the conductor C3 to the conductors C1, C2 (pair P2), the electrical coupling between these conductors is relatively strong. Conversely, the electrical coupling between conductor C3 and conductors C7, C8 of pair P4 is relatively weak due to the much farther physical distance between these conductors. The same is true of conductor C6 except in reverse, namely conductor C6 is strongly coupled to conductors C7, C8 of pair P4 and weakly coupled to conductors C1, C2 of pair P2. Pair P1 (conductors C4, C5) can also cause modal alien crosstalk due to common mode signals induced on conductors C1,C2 of pair P2 and on conductors C7, C8 of pair P4. The relatively small distance between conductors C4, C5 of pair P1, however, means that any such common mode signals are much smaller than those caused by conductors C3, C6 of pair P3, as will be appreciated by those skilled in the art. This is true at the frequencies of signals being communicated by CAT6 and CAT6A outlets and thus modal alien crosstalk caused by pair P1 will not be discussed in more detail herein. As the frequency of signals being communicated continues to increase, however, modal alien crosstalk caused by conductors C4 and C5 of pair P1 may become significant and require that separate compensation be added to outlets to reduce such crosstalk.

This unequal electrical exposure of conductors C3, C6 of the split pair P3 causes unwanted common mode signals to be induced or generated on both conductors C1, C2 of pair P2 and on both conductors C7, C8 of pair P4. The signal on conductor C3 generates the unwanted common mode signal on conductors C1, C2 while the signal on conductor C6 generates the unwanted common mode signal on conductors C7, C8. A signal propagating down a twisted pair of conductors in a cable such as the cable 106 of FIG. 1 will encounter the plug 104, at which point the conductors C3 and C6 of the plug are split, as illustrated in the schematic of FIG. 4. Recall, FIG. 4 is the schematic of the outlet 200 but the schematic of the conductors C1-C8 in a corresponding plug are arranged similarly so the two properly interface. At this point, the signal entering the plug propagates on conductors C3 and C6 and generates the above-described unwanted common mode signals on pairs P2 and P4. The same situation is true for signals propagating in the opposite direction on cable 106 (FIG. 1) which first encounter the outlet 200 and then plug 104, with the outlet and plug both generating the unwanted common mode signals on pairs P2 and P4 and the plug 104 doing the same due to the same arrangement of conductors C.

The unwanted common mode signals generated on pairs P2 and P4 are approximately equal in magnitude but are opposite in polarity. This is illustrated in FIG. 6 which is a simplified schematic diagram that depicts two adjacent communications channels 600*a* and 600*b* which will now be used to describe modal alien crosstalk in more detail. Each of the communications channels 600*a* and 600*b* are analogous to a portion of the communications channel 101 in the network 100 of FIG. 1. FIG. 6 illustrates two communications channels 600*a* and 600*b* that are positioned parallel and proximate each other such that modal alien crosstalk may present an issue that interferes with proper operation of the channels at high frequencies. The communications channel 600*a* includes a cable 106*a* having communication outlets 102*a* and 102*b* attached to each end of the cable. Plugs 104*a* and 104*b* are shown inserted in the communications outlets 102*a* and 102*b*, respectively. Similarly, the communications channel 600*b* includes a cable 106*b* having communications outlets 102*c* and 102*d* attached to each end of the cable and plugs 104*c* and 104*d* inserted in these outlets. The cables 106*a* and 106*b* may be two adjacent cables 500 in the cross-sectional bundle of cables 500 illustrated in FIG. 5, such as cables 500*a*-500*b*, 500*a*-500*c*, or 500*d*-500*e*, for example. The same reference numerals have been utilized in FIG. 6 as were utilized in FIG. 1 to identify like components except that a letter has been appended to each reference numeral since more than one of each component is present in FIG. 6. Each of the cables 106, outlets 102, and plugs 104 includes eight conductors C1-C8 in the form of four pairs P1-P4, as previously described with reference to FIG. 4. The conductors C1-C8 are illustrated for each of the outlets 102*a* through 102*d*.

Figure 6:
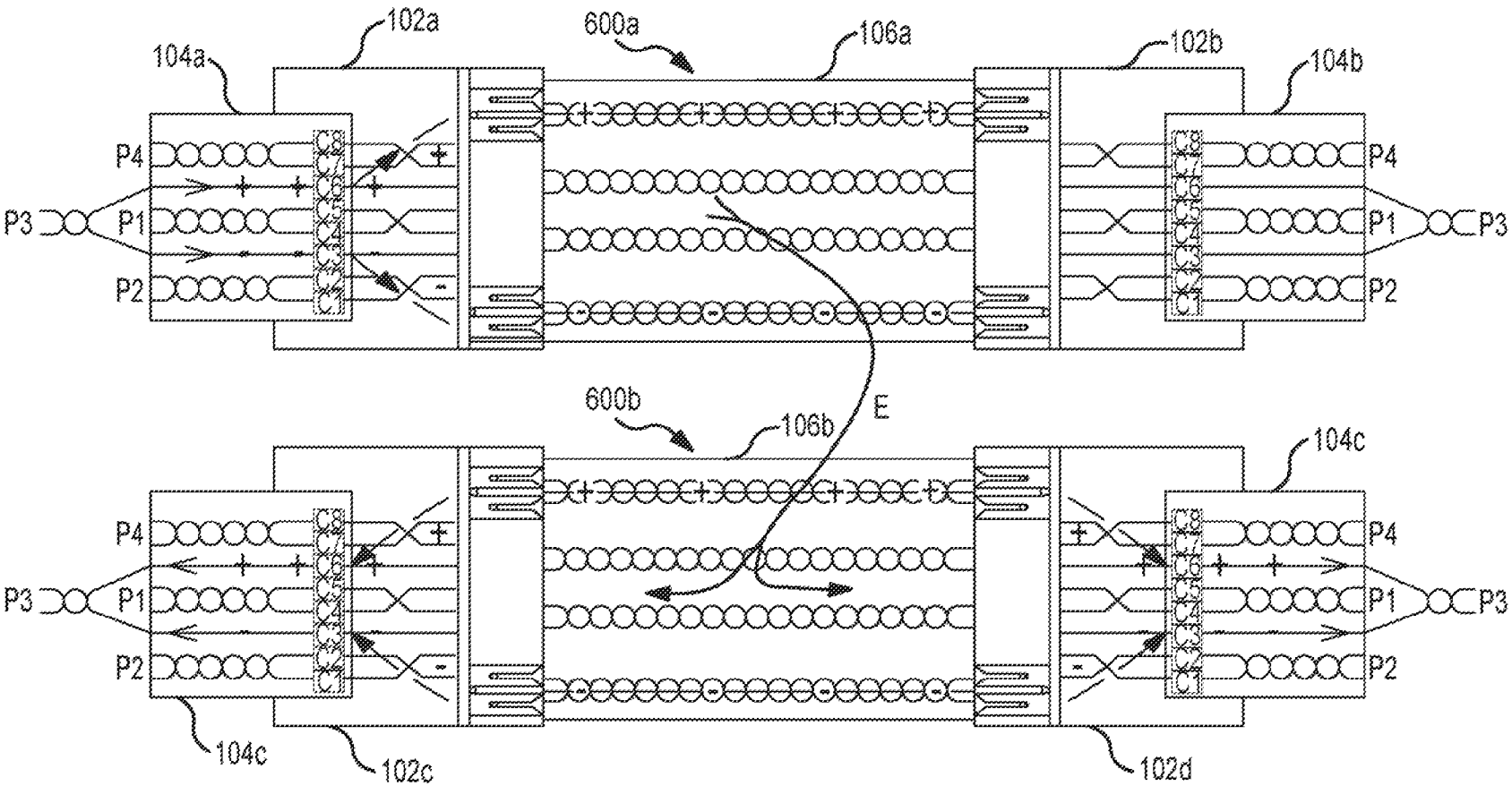
FIG. 6 is a simplified schematic diagram that depicts two adjacent communications channels in the communications system of FIG. 1 and illustrates the phenomenon of modal alien crosstalk.

Within the cables 106, and cables not shown that are attached to the plugs 104, each of the pairs P1-P4 is formed by a twisted pair of wires as illustrated in FIG. 6 in the form of circular shapes for these wires. A signal propagating from left to right down the twisted pair connected to conductors C3, C6 in plug 104*a* causes unwanted common mode signals on the conductors C1, C2 and C7, C8, respectively. The outlet 102*a* does the same since the arrangement of the conductors C1-C8 is the same as in the plug 104*a*. These signals on conductors C1, C2 and C7, C8 travel as common mode signals down the twisted pair in cable 106*a* for the length of this cable and the length of the channel 600*a*, propagating on both wires in each of the pairs P2 and P4. One wire in each pair P is commonly known, for historical reasons, as a "tip" conductor and the other a "ring" conductor, and these signals thus travel down the tip and ring conductors of pair P2 and the tip and ring conductors of pair P4.

The unwanted common mode signals introduced on conductors C7, C8 of pair P4 are approximately equal in magnitude to the unwanted common mode signals introduced on conductors C1, C2 of pair P2 except that these unwanted signals have opposite polarities as indicated by the "+" and "−" signs in FIG. 6. Together these two signals can be viewed as an incidental differential-mode signal propagating along a newly formed pair made up of both conductors C7, C8 of pair P4 and conductors C1, C2 of pair P2. Because of the physical characteristics of the parasitic or incidental transmission line on which this incidental differential-mode signal propagates, such as the relatively wide spacing and uncontrolled geometry of a core defined between the newly formed conductors, energy is easily radiated from this newly formed incidental differential-mode pair. As a result, the signal from the incidental differential-mode pair of channel 600*a* may radiate energy E into the incidental differential-mode pair in the channel 600*b* and vice versa. This is illustrated through the arrow labeled E in FIG. 6. This type of coupling between channels 600*a*, 600*b* is known as modal alien crosstalk. It should be noted that modal alien crosstalk can add to total alien crosstalk including both PSANEXT and PSAACR-F.

Once this signal from channel 600*a* is coupled into the incidental differential-mode pair of channel 600*b*, the signal on the incidental differential-mode transmission line is coupled to, or generates crosstalk on, the conductors C3 and C6 of pair P3 in this channel in a similar, but reverse, manner to how the signals on the differential-mode transmission line in channel 600*a* were generated. Note that although FIG. 6 illustrates only two channels, the incidental differential-mode signal generated in a given channel may be coupled into, or generate crosstalk on, numerous surrounding channels positioned proximate that channel.

Modal alien crosstalk can lead to unsatisfactory performance of communications channels 600*a* and 600*b* resulting in a level of crosstalk that can cause a failure of, or degradation in, performance of a communications channel required to meet desired levels of performance. Returning now to FIG. 4, the first modal alien crosstalk compensation stage 202 functions to reduce modal alien crosstalk such that desired performance characteristics can be achieved in high frequency communications channels. The structure of the compensation stage 202, and operation of this stage in reducing modal alien crosstalk, will now be described in more detail.

The first modal alien crosstalk compensation stage 202 includes four modal capacitors CMC37, CMC38, CMC16, and CMC26 formed on the rigid printed circuit board 300 of the outlet 200 (see FIG. 4). The modal capacitor CMC37 is connected between the conductive traces CT3 and CT7 to couple the signal on tine T3 onto the conductive trace CT7. Similarly, the modal capacitor CMC38 is connected between the conductive traces CT3 and CT8 to couple the signal on tine T3 onto the conductive trace CTB. The modal capacitor CMC16 is connected between the conductive traces CT1 and CT6 to couple the signal on tine T6 onto the conductive trace CT1 and the modal capacitor CMC26 is connected between the conductive traces CT2 and CT6 to couple the signal on tine T6 onto the conductive trace CT2.

In operation, as shown in FIG. 4, the four independent modal capacitors CMC37, CMC38, CMC16, and CMC26 of the first modal alien crosstalk compensation stage 202 function to introduce common mode signals onto the second and fourth pairs P2 and P4 of outlet tines T1-T8 that have the opposite polarity as common mode signals present on the second and fourth pairs near the free ends 304 of the outlet tines. More specifically, the modal capacitors CMC introduce common mode signals having the opposite polarity as common mode signals present on pairs P2 and P4 at a point 310 that corresponds to the place where the contacts of a plug (not shown) inserted into the outlet 200 touch the outlet tines T1-T8 generally and, more specifically, the outlet tines T1, T2 of the second pair P2 and tines T7, T8 of the fourth pair P4. The four independent modal capacitors CMC37, CMC38, CMC16, and CMC26 introduce these common mode signals of opposite polarity into the pairs P2 and P4 proximate fixed ends 302 of the tines T1-T8 which are connected to the rigid printed circuit board 300.

Figure 7A:
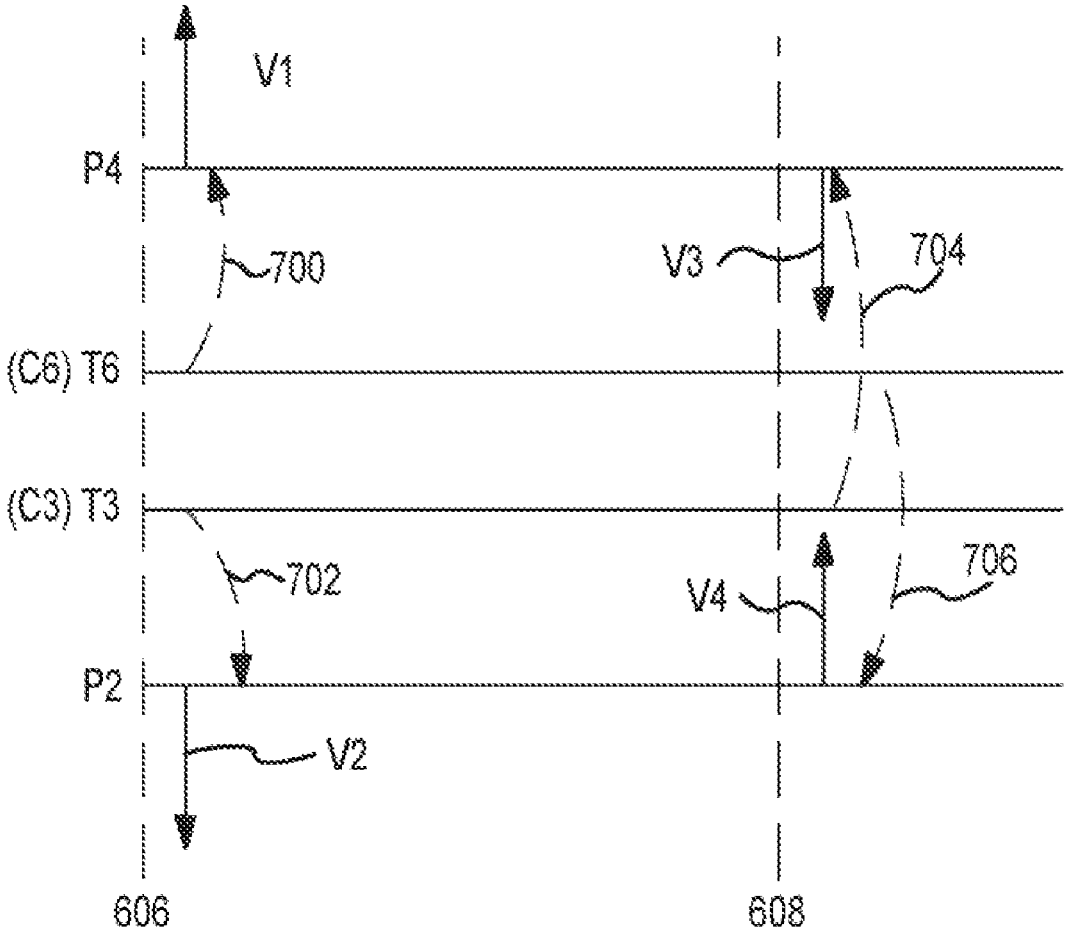
FIG. 7A is a vector signal diagram illustrating the operation of the first modal alien crosstalk compensation stage of FIG. 4 in reducing modal alien crosstalk within the communications outlet.

The operation of the first modal alien crosstalk compensation stage 202 will now be described in more detail with reference to FIG. 7A. FIG. 7A depicts a vector signal diagram illustrating how the first modal alien crosstalk compensation stage 202 of FIG. 4 reduces modal alien crosstalk in the communications outlet 200. As previously discussed with reference to FIG. 6, common mode signals are induced on the conductors C1, C2 of pair P2 and on conductors C7, C8 of pair P4 due to the phenomena of modal alien crosstalk. As a result, these common mode signals are present on the pairs P2 and P4 when the signals on these pairs enter the outlet 200 at the point 310 where the tines of a plug (not shown), which is inserted into the outlet, touch the tines of pairs P2 and P4 (see FIG. 4). These common mode signals are originally generated in the plug (not shown) inserted into the outlet 200 due to the similar arrangement of the conductors within the plug. The common mode signals present on the pairs P2 and P4 at the point 310 are represented by a vector V1 having a positive magnitude for the pair P4 and a vector V2 having a negative magnitude for the pair P2. A dotted arrow 700 indicates that the common mode signal on pair P4, represented by vector V1, is caused by coupling from the signal on conductor C6 to pair P4. Similarly, a dotted arrow 702 indicates that the common mode signal on pair P2 represented by vector V2 is caused by coupling from the signal on conductor C3 to pair P2.

The common mode signals introduced on the pairs P2 and P4 at approximately the fixed ends 302 of the tines T1-T8 by the first modal alien crosstalk compensation stage 202 are shown on the right side of FIG. 7A. The common mode signal on pair P4 is represented by a vector V3 having a magnitude that is approximately the same as the magnitude of vector V1 but having an opposite polarity (i.e., vector V3 is negative instead of positive), effectively cancelling or greatly reducing the magnitude of the common mode signal on pair P4 as represented by vector V1. In other words, the sum of V1+V3 is near zero. Similarly, the common mode signal for the pair P2 is represented by a vector V4 having a magnitude approximately equal to the magnitude of vector V2 but with the opposite polarity. Once again, the sum of V2+V4 is near zero to greatly reduce the magnitude of the unwanted common mode signal on pair P2. A dotted arrow 704 indicates that the common mode signal on pair P4, introduced or generated by the first modal alien crosstalk compensation stage 202 represented by vector V3, is caused by coupling the signal on tine T3 or conductor C3 to pair P4. Similarly, a dotted arrow 706 indicates that the common mode signal on pair P2, represented by vector V4, is caused by coupling the signal on tine T6 or conductor C6 to pair P2. In this way, the first modal alien crosstalk compensation stage 202 functions to greatly reduce modal alien crosstalk in the corresponding communications channel by coupling common mode signals onto pairs P2 and P4 that have the opposite polarity as common mode signals generated on these pairs in a mated plug-outlet combination.

Figure 7B:
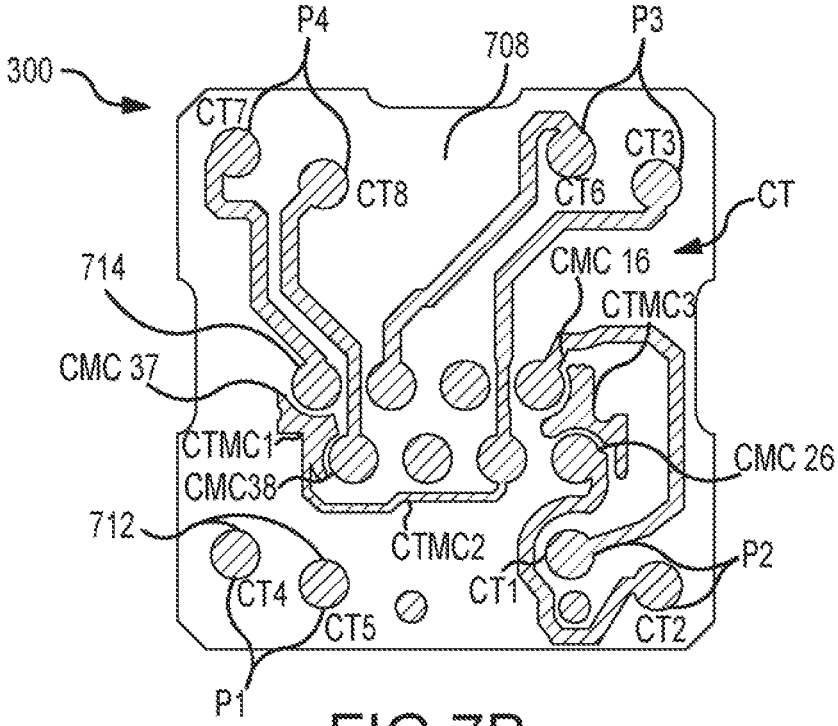
FIGS. 7B and 7C illustrate the physical layouts of a top layer and a bottom layer, respectively, of conductive traces formed on the printed circuit board of the communications outlet FIGS. 2 and 3 according to one embodiment of the present invention.
Figure 7C:
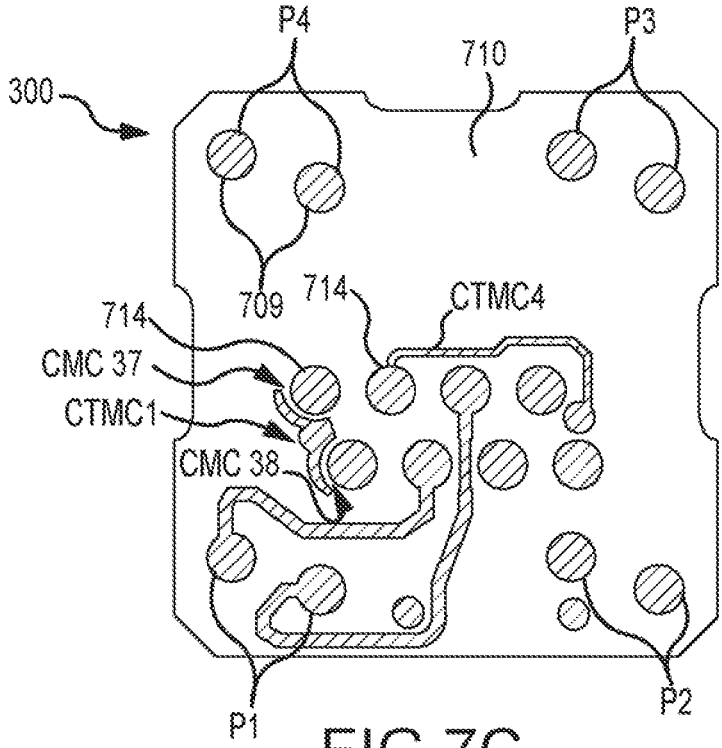

FIGS. 7B and 7C illustrate the physical layouts of a top layer 708 and a bottom layer 710, respectively, of conductive traces CT formed on the printed circuit board 300 of the communications outlet 200 of FIGS. 2 and 3 according to one embodiment of the present invention. The layout of the top layer 708 in FIG. 7B shows four pairs of through holes or vias 712, with each pair of vias being positioned near a corner of the circuit board 300 as shown. The pairs P1-P4 associated with each pair of vias 712 are designated in the figure, along with the conductive traces CT1-CT8 associated with each pair. The wire termination contacts 206 (not shown in FIG. 7B), such as IDCs, are inserted in the vias 712 when the outlet 200 is assembled. The circuit board 300 further includes eight vias 714 positioned towards the center of the board, with only one of these vias being labeled with reference number 714 to simplify the figure. The fixed ends 302 (see FIG. 3) of the tines T1-T8 are inserted in the vias 714 to physically attach the tines to the board 300 and to electrically couple the tines to the conductive traces CT.

The conductive traces CT forming the modal capacitors CMC are also shown in the figure. More specifically, the modal capacitors CMC37 and CMC38 are formed, in part, by conductive traces designated CTMC1 positioned adjacent traces CT7 and CT8 near the corresponding vias 714. These conductive traces CTMC1 are connected through another conductive trace CTMC2 to conductive trace CT3. As seen in FIG. 7C, conductive traces CTMC1 are also formed on the bottom layer 710. The modal capacitors CMC37 and CMC38 are formed by all these conductive traces collectively.

Similar to the modal capacitors CMC37 and CMC38, the modal capacitors CMC16 and CMC26 are formed, in part, by conductive traces designated CTMC3 positioned adjacent traces CT1 and CT2 near the corresponding vias 714. These conductive traces CTMC3 are connected through a via 714 and another conductive trace CTMC4 formed on the bottom layer 710 as shown in FIG. 7C to the via 714 of conductive trace CT6. The modal capacitors CMC16 and CMC26 are formed by all these conductive traces collectively. Note that while the modal capacitors CMC are formed through conductive traces CT formed on the printed circuit board 300 in the described embodiment, these modal capacitors are formed in different ways in other embodiments of the present invention.

Figure 8A:
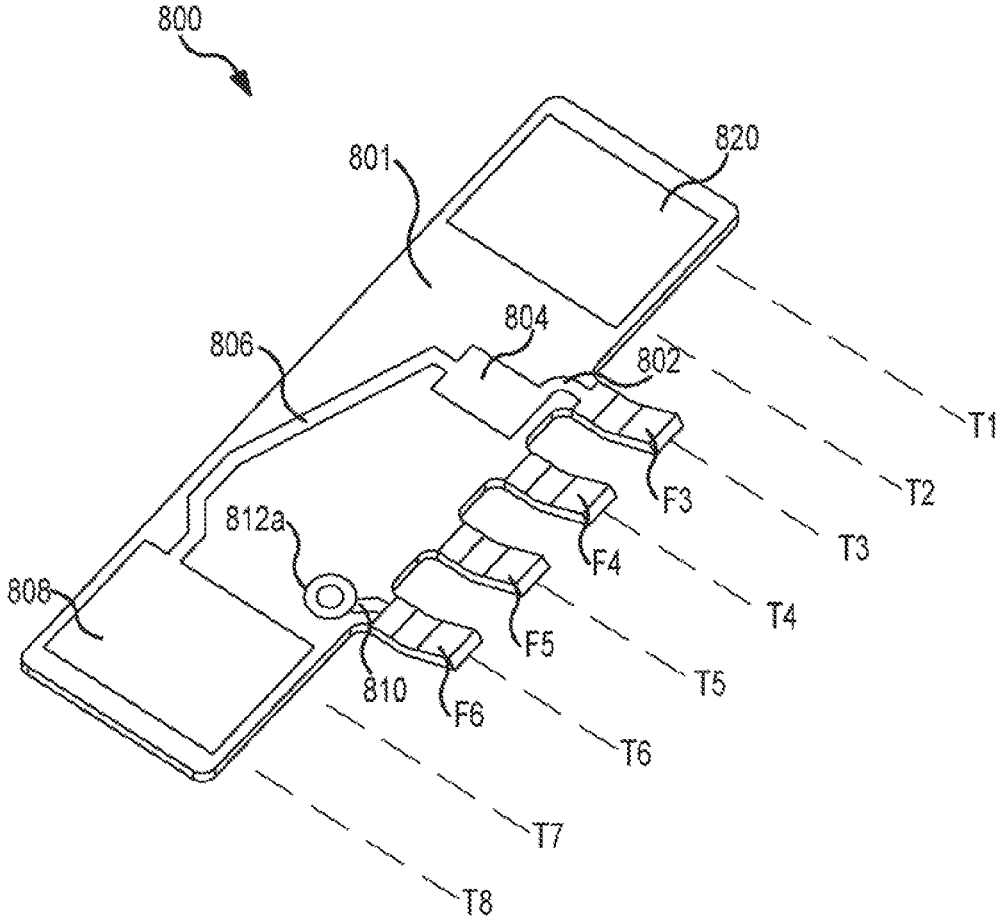
FIGS. 8A and 8B are perspective views of the physical layout of the flexible printed circuit board of FIG. 3 on which the first modal alien crosstalk compensation stage is formed according to another embodiment of the present invention.
Figure 8B:
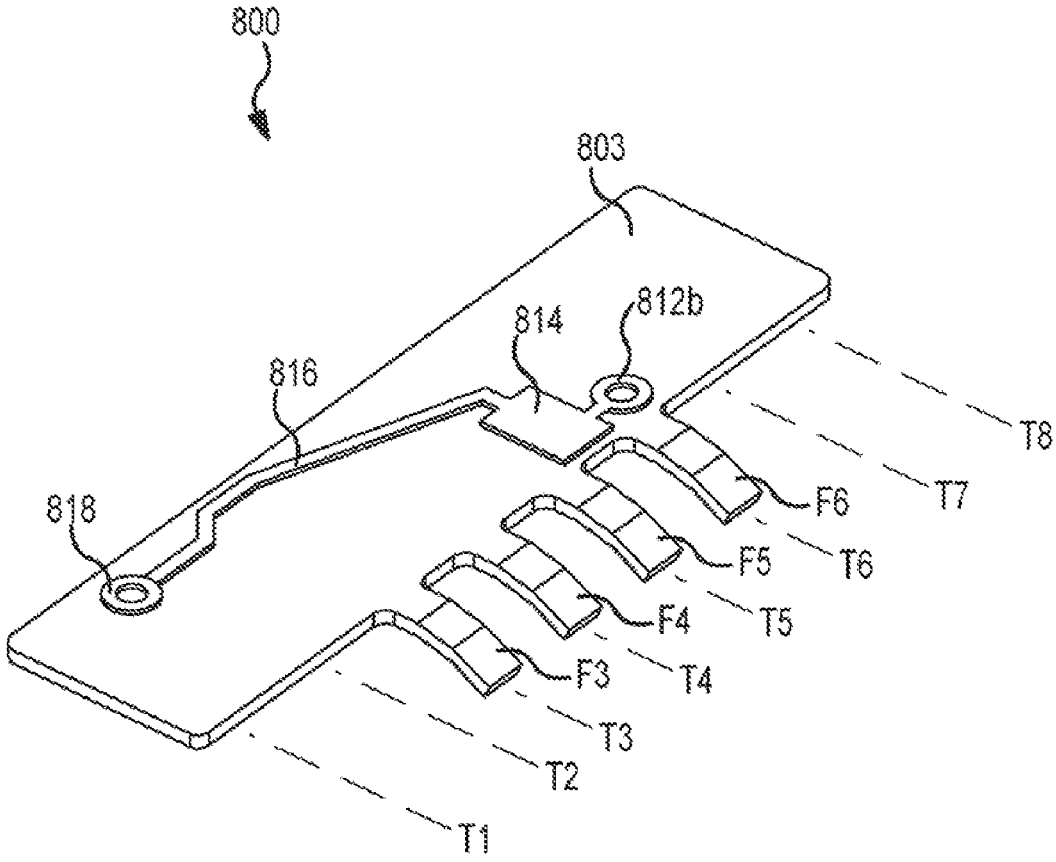

FIGS. 8A and 8B are perspective views illustrating the physical layout of a flexible printed circuit board 800 that forms the first modal alien crosstalk compensation stage 202 of FIG. 3 according to another embodiment of the present invention. Thus, in the embodiment of FIGS. 8A and 8B, the modal capacitors CMC37, CMC38, CMC16, and CMC26 are formed not on the rigid printed circuit board 300 discussed with reference to FIG. 4, but instead are formed on the flexible printed circuit board 800 which is attached to the tines T and positioned between the tines and the resilient spring arms 306 as illustrated in and previously discussed with reference to FIG. 3.

FIG. 8A illustrates a top surface 801 of the board 800 and FIG. 8B a bottom surface 803 of the board. Referring first to FIG. 8A, the flexible printed circuit board 800 includes four conductive attachment segments or fingers F, which are designated F3-F6 so that each finger has the same reference number as the corresponding tine T3-T6 to which that finger is physically attached. The conductive attachment fingers F3-F6 may be attached to the tines T3-T6 by soldering, spot welding, electrically conductive adhesives, or any other suitable method. The conductive attachment finger F3, which attaches to the tine T3, is connected via a conductive trace 802, conductive pad 804, and conductive trace 806 to a first modal plate 808. The conductive attachment finger F6 that attaches to tine T6 is connected to a first conductive trace 810 and a first portion 812*a* of a via or through hole as shown in FIG. 8A on the top surface 801 of the board 800.

Now referring to FIG. 8B, a second portion 812*b* of the through hole 812*a* is shown and is connected through a conductive pad 814 and conductive trace 816 to a portion 818 of a second through hole as shown in FIG. 8B on the bottom surface 803 of the board 800. The portion 818 of the second through hole connects through the board (not shown) to a second modal plate 820 on the top surface 801 of the board as shown in FIG. 8A.

When the flexible printed circuit board 800 is attached to the tines T3-T6 via the conductive attachment fingers F3-F6 and positioned between the resilient spring arms 306 and the tines as shown in FIG. 3, the first modal plate 808 is positioned adjacent, but not touching, tines T7 and T8 to form the modal capacitors CMC37, CMC38 previously discussed with reference to FIG. 6. The second modal plate 820 is similarly positioned adjacent, but not touching, tines T1 and T2 to form the modal capacitors CMC16, CMC26. While the first and second modal plates 808 and 820 are described as not touching the adjacent tines T7, T8 and T1, T2, the top surface 801 and bottom surface 803 of the circuit board 800 are, in one embodiment, coated with an electrically insulating protective coating to ensure there is no danger of the modal plates 808, 820, or other components of the flexible printed circuit board 800, electrically short circuiting any of the tines T1-T8 of the outlet 200. In one embodiment, the conductive attachment fingers F3-F6 are physically positioned proximate the free ends 304 of the tines T3-T6 to electrically connect the independent modal capacitors CMC to the second and fourth pairs P2 and P4 of tines proximate their free ends and thus very near the point 310 (FIG. 4) where the contacts of a plug inserted into the outlet 200 contact the tines T.

Note that in the sample embodiment of the flexible printed circuit board 800 of FIG. 8, the printed circuit board includes the conductive pad 804 formed on the top surface 801 and conductive pad 814 formed on the bottom surface 803. The pads 804 and 814 form capacitances that are utilized in eliminating internal crosstalk and not modal alien crosstalk in the outlet 200, and are illustrated merely to show that such components can also be formed on the flexible printed circuit board 800 along with modal capacitive elements. For example, other capacitive components to reduce internal crosstalk within the outlet 200 can also be formed on the flexible printed circuit board 800.

Figure 8C:
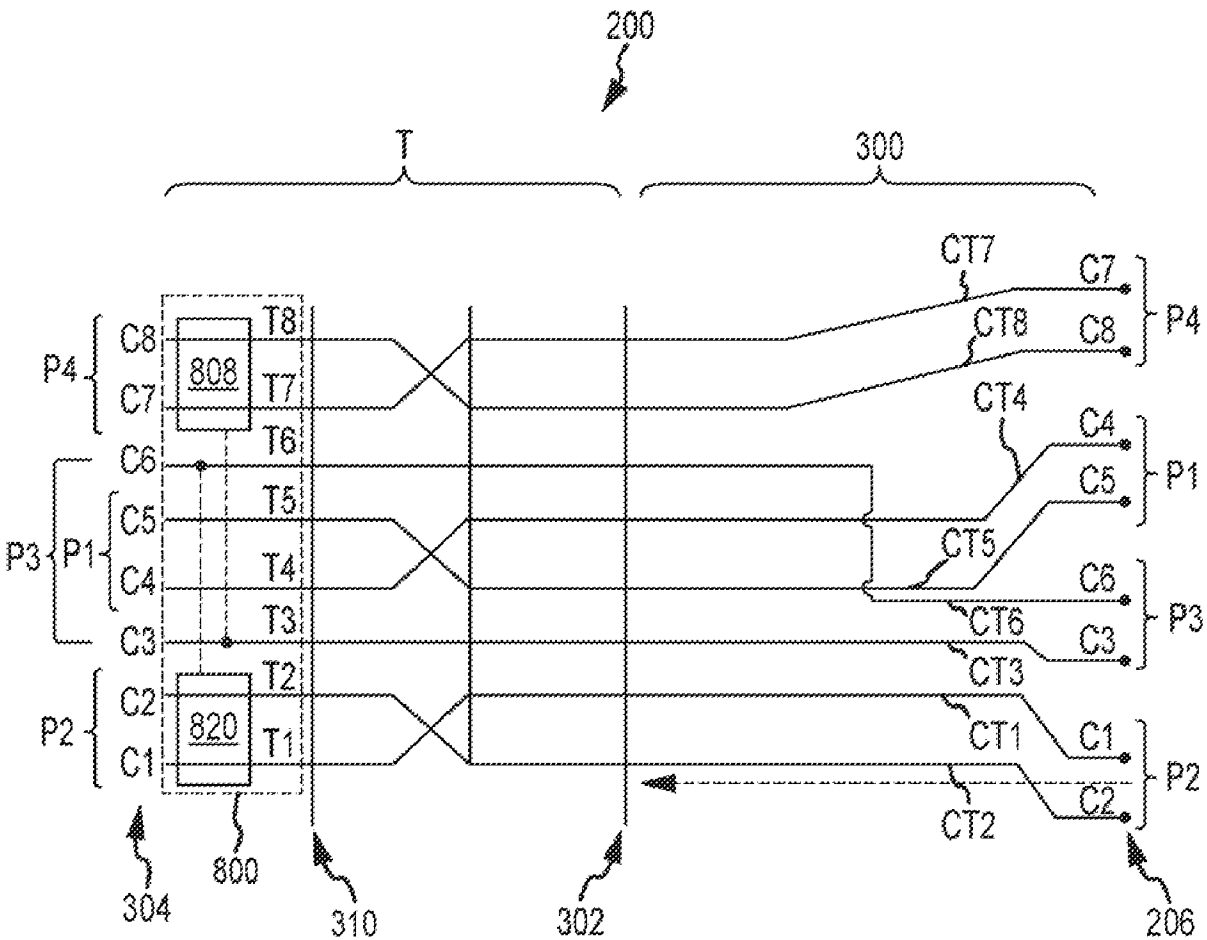
FIG. 8C is a schematic of the communications outlet of FIGS. 2 and 3 where the first modal alien crosstalk compensation stage for reducing modal alien crosstalk is formed on the flexible printed circuit board of FIGS. 8A and 8B.

FIG. 8C is a schematic of the communications outlet 200 of FIGS. 2 and 3 where the first modal alien crosstalk compensation stage 202 for reducing modal alien crosstalk is formed on the flexible printed circuit board 800 of FIGS. 8A and 8B. Thus, FIG. 8C is the same as FIG. 4 except that the first modal alien crosstalk compensation stage 202 is formed not on the rigid printed circuit board 300 as in FIG. 4, but on the flexible printed circuit board 800. The flexible printed circuit board 800 is connected to the tines proximate the free ends 304 (FIG. 3) of the tines T and ideally as near the point 310 as possible, where the point 310 is the point where the contacts of a plug (not shown) inserted into the outlet 200 touch the outlet tines T. As shown in the figure, the modal plate 820 is positioned near tines T1, T2 and is connected to tine T6 via the flexible printed circuit board 800. In this way, the modal plate 820 and tines T1, T2 form the modal capacitors CMC16 and CMC26. The modal plate 808 is positioned near tines T7, T8 and is connected to tine T3 via the flexible printed circuit board 800 so that this modal plate 808 and tines T7, T8 form the modal capacitors CMC37 and CMC38.

Figure 9:
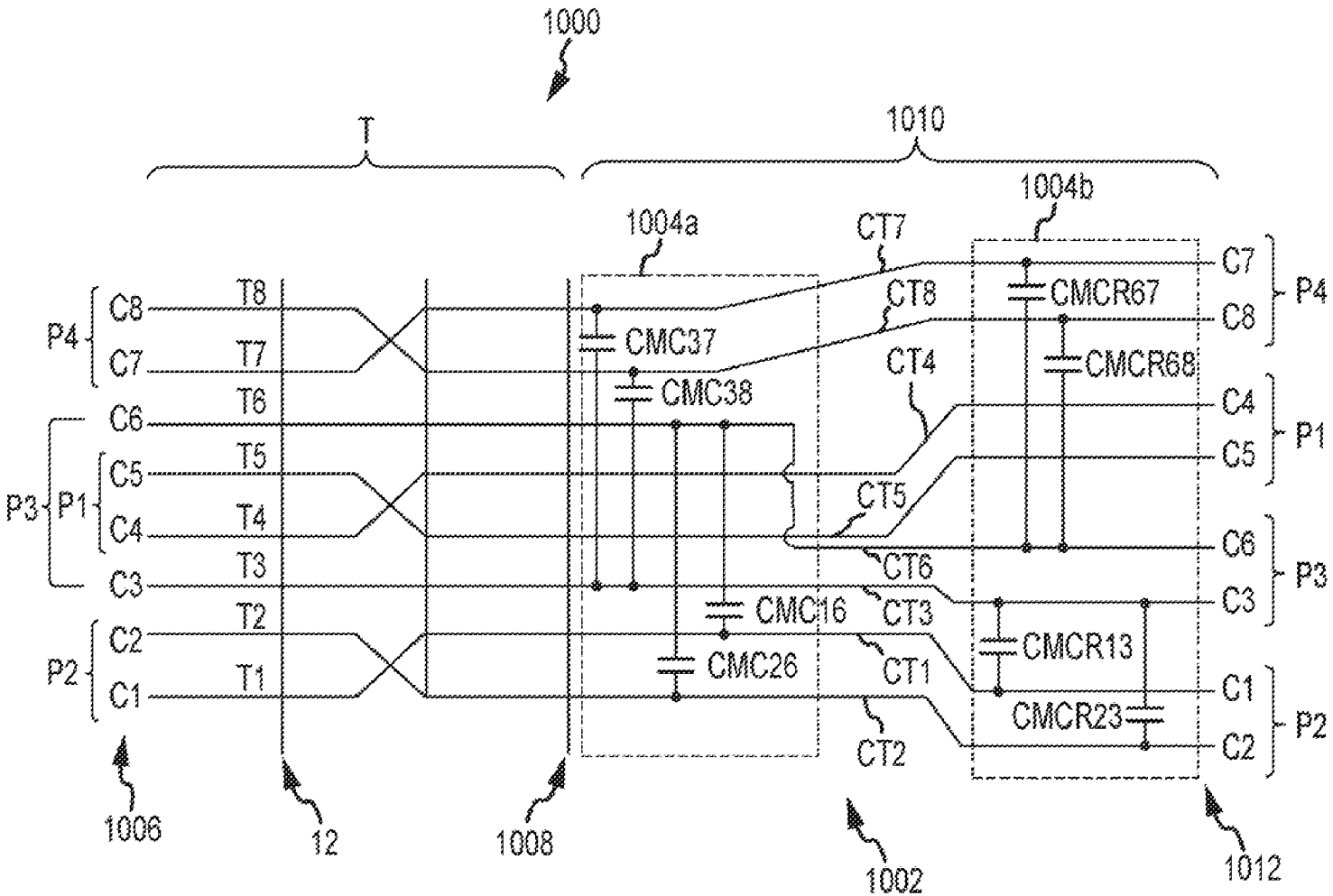
FIG. 9 is a schematic of a communications outlet including a dual modal alien crosstalk compensation stage to reduce the modal alien crosstalk within the outlet according to another embodiment of the present invention.

FIG. 9 is a schematic of a communications outlet 1000 including a dual modal alien crosstalk compensation stage 1002 including first and second modal alien crosstalk compensation stages 1004*a* and 1004*b* for reducing modal alien crosstalk within the communications outlet according to another embodiment of the present invention. The outlet 1000 includes eight conductors C, tines T having free ends 1006 and fixed ends 1008 thereof, a rigid printed circuit board 1010, conductive contacts such as wire termination contacts 1012, and conductive traces CT1-CT8 on the rigid printed circuit board. These components have previously been discussed in more detail with reference to corresponding components of the outlet 200 of FIG. 4 so they will not again be described in detail. Instead, only pertinent differences between the components 1006-1012 and the corresponding components in FIG. 4 will be discussed in more detail in the following discussion.

The first modal alien compensation stage 1004*a* is the same as the first modal alien compensation stage 202 of FIG. 4 and, accordingly, will not again be described in detail. In the embodiment of FIG. 9, the second modal alien crosstalk compensation stage 1004*b* is also formed on the rigid printed circuit board 1010 but is formed so that the modal capacitors CMC of this stage connect to the conductive traces CT on the printed circuit board proximate the ends of these traces where the wire termination contacts 1012 connect to the printed circuit board. The second modal alien crosstalk compensation stage 1004*b* includes four independent modal capacitive elements just as stage 1004*a*. More specifically, the second modal alien crosstalk compensation stage 1004*b* includes a first reverse modal capacitor CMCR13 connected between conductive traces CT1 and CT3 and a second reverse modal capacitor CMCR23 connected between conductive traces CT2 and CT3. In this way, the first and second reverse modal capacitors CMCR13, CMCR23 couple a common mode signal onto the pair P2 (traces CT1, CT2) responsive to the signal on the trace CT3 (i.e., on conductor C3). The second modal alien crosstalk compensation stage 1004*b* further includes a third reverse modal capacitor CMCR67 connected between conductive traces CT6 and CT7 and a fourth reverse modal capacitor CMCR68 connected between conductive traces CT6 and CT8. These third and fourth modal capacitors CMCR67, CMCR68 couple a common mode signal onto the pair P4 (traces CT7, CT8) responsive to the signal on the trace CT6 (i.e., on conductor C6).

Figure 10:
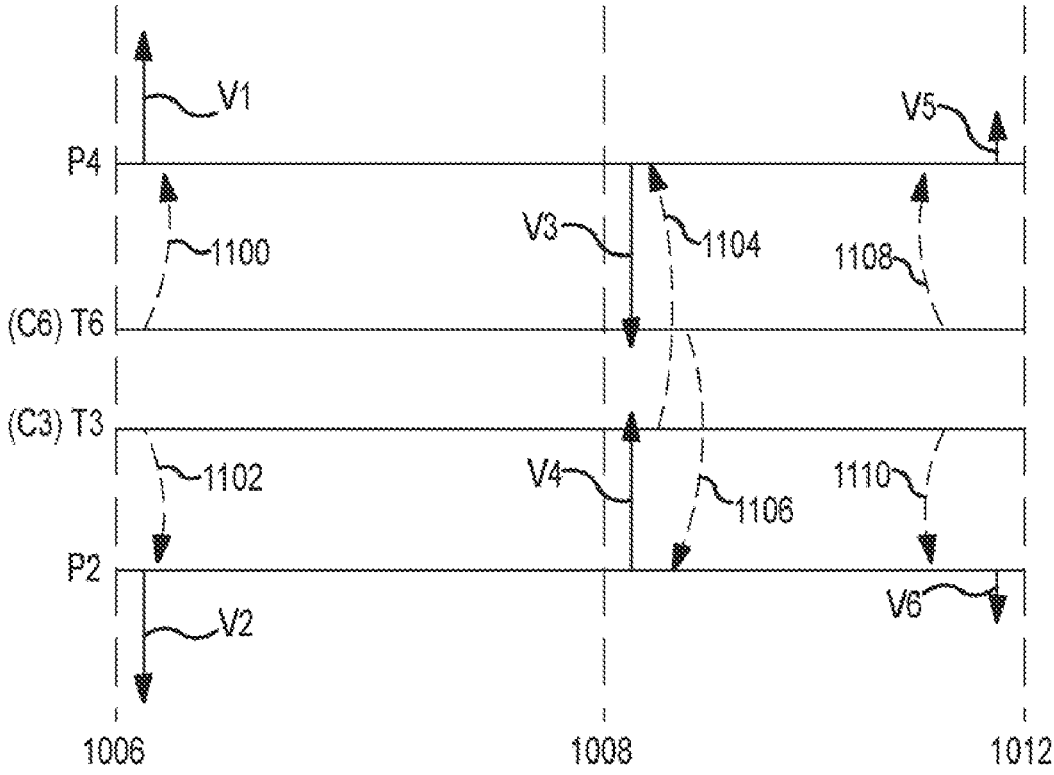
FIG. 10 is a vector signal diagram illustrating the operation of the dual modal alien crosstalk compensation stage of FIG. 9 in reducing modal alien crosstalk.

In operation, the second modal alien compensation stage 1004*b* provides electrical compensation that is considerably less in magnitude than that applied by the first modal alien compensation stage 1004*a* and is in the opposite polarity. The second stage of modal compensation is also delayed in time from the first stage of modal compensation. This is accomplished by locating the second stage in the circuit some significant physical distance from the first stage. This operation is illustrated in the vector signal diagram of FIG. 10, which shows the operation of the dual modal alien crosstalk compensation stage 1002 including stages 1004*a* and 1004*b* of FIG. 9. The left portion of FIG. 10 illustrates common mode signals on the pairs P2 and P4 near the free ends 1006 of the tines T and illustrates compensating signals introduced at the fixed ends 1008 of the tines T. This portion of FIG. 10 illustrates the vectors V1-V4 and dotted arrows 1100-1106 that correspond to the dotted arrows 700-706 of FIG. 7A. However, when dual-stage compensation is used, vectors V3 and V4 are somewhat larger in magnitude than they typically are when using single stage compensation. The larger magnitude of 1004*a* stage is necessary to electrically combine with the second part of the dual stage compensation 1004*b* to have a net result of modal nullification of the original vectors V1 and V2.

The common mode signals introduced on the pairs P2 and P4 at approximately the fixed ends 1008 of the tines T1-T8 by the first modal alien crosstalk compensation stage 1004*a* are shown in FIG. 10. The common mode signal added on pair P4 is represented by a vector V3 having a magnitude that is larger than the magnitude of vector V1 but having an opposite polarity i.e., vector V3 is negative instead of positive. The second stage, electrically delayed, V5 has a magnitude opposite of V3 that is approximately the difference between V3 and V1. The net result of V3+V5 effectively cancels, or greatly reduces, the magnitude of the common mode signal on pair P4 as represented by vector V1. In other words, the sum of V1+V3+V5 is near zero. Similarly, the common mode signal for the pair P2 is represented by a vector V4 having a magnitude that is larger than the magnitude of vector V2 but having an opposite polarity. Once again, the sum of V2+V4+V6 is near zero to greatly reduce the magnitude of the unwanted common mode signal on pair P2. The dotted arrows 1104 and 1108 indicate that the common mode signals on pair P4, introduced or generated by the dual modal alien crosstalk compensation stage 1004*a* and 1004*b* represented by vector V3 and V5 respectively, are caused by coupling the signal on tine T3 or conductor C3 to pair P4. Similarly, dotted arrows 1106 and 1110 indicate that the common mode signals on pair P2, represented by vectors V4 and V6, are caused by coupling the signal on tine T6 or conductor C6 to pair P2. In this way, the dual modal alien crosstalk compensation stages 1004*a* and 1004*b* function to greatly reduce modal alien crosstalk in the corresponding communications channel by coupling common mode signals onto pairs P2 and P4 that have a net combined vector in opposite polarity as common mode signals generated on these pairs in a mated plug-outlet combination such as 126 and 118 shown in FIG. 1.

As seen in FIG. 9, the second modal alien crosstalk compensation stage 1004*b* is connected to the corresponding conductive traces CT proximate the wire termination contacts 1012 to introduce a common mode signal represented by the vector V5 of FIG. 10 onto the pair P4 and a common mode signal represented by the vector V6 onto the pair P2. Thus, the capacitors CMCR67, CMCR68 function to couple the signal on tine T6 and trace CT6 onto the pair P4 as the common mode signal represented by vector V5. A dotted arrow 1108 in FIG. 10 indicates that the common mode signal on pair P4 represented by vector V5 is caused by coupling from the signal on conductive trace CT6 to pair P4 through capacitors CMCR67 and CMCR68. Similarly, a dotted arrow 1110 indicates that the common mode signal on pair P2 represented by vector V6 is caused by coupling the signal on conductive trace CT3 to pair P2 through capacitors CMCR13, CMCR23. The dual modal alien crosstalk compensation stage 1002 improves the performance of outlet 1000 over that of an outlet using only single stage modal compensation by further nullifying the unwanted common mode signal generated in the plug and mated outlet at higher frequencies.

Figure 11:
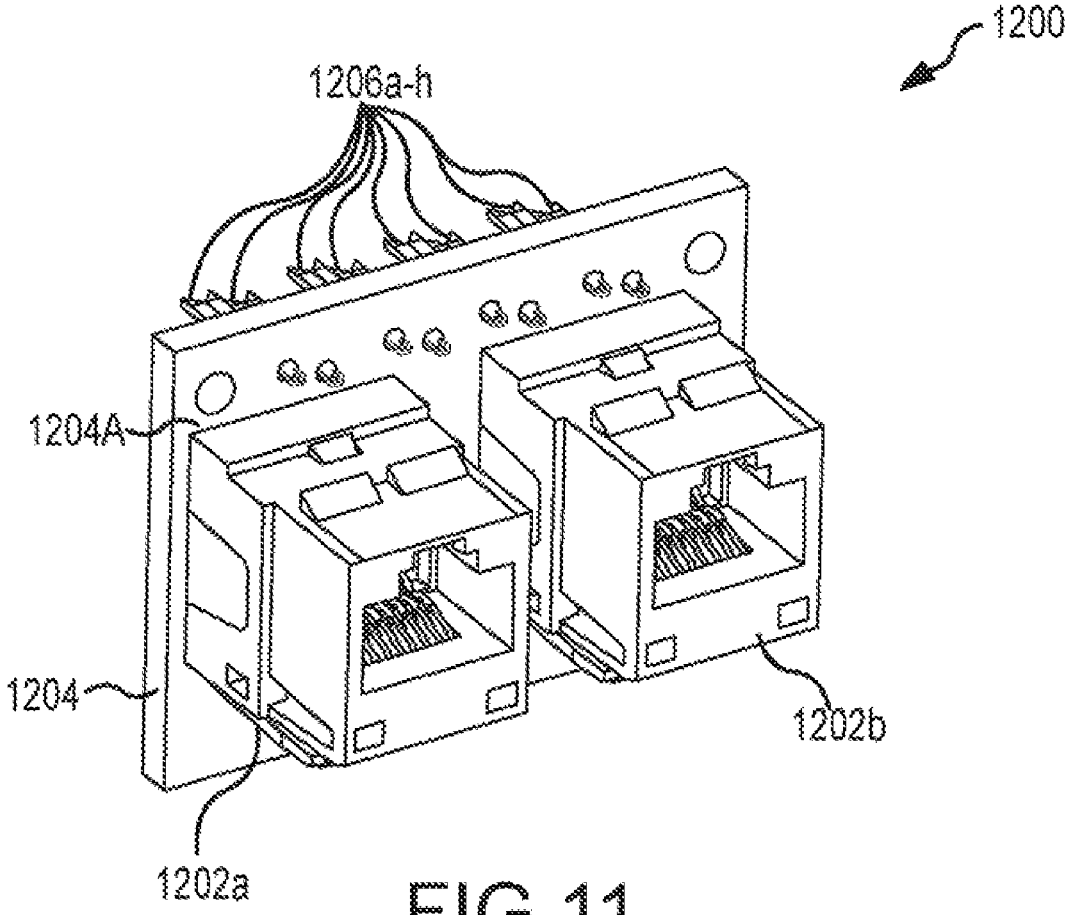
FIG. 11 is a perspective view of a portion of a patch panel including two communications outlets mounted on a common rigid printed circuit board on which individual dual modal alien crosstalk compensation stages are formed for each of the outlets according to another embodiment of the present invention.

FIG. 11 is a perspective view of a printed circuit board assembly 1200, on which two outlets 1202*a* and 1202*b* have been located in such a manner as to provide conventional crosstalk isolation between the two circuits. This assembly can be used in various arrangements to provide a plurality of outlets located in close proximity to each other which is often referred to as a patch panel. On a printed circuit board 1204 there are two individual dual stage modal alien crosstalk compensation circuits formed, one for each of the outlets, in accordance with the embodiment of the present invention. The two outlets 1202*a* and 1202*b* are mounted on a first side 1204*a* of the printed circuit board 1204 while 16 wire termination contacts 1206*a-p*, (eight for each outlet), only some of which are shown in FIG. 11, are mounted on a second side 1204*b* of the printed circuit board. In this embodiment, the wire termination contacts 1206 facilitate the connection of two four pair cables, one cable for each outlet, 1202*a* and 1202*b*.

Figure 12A:
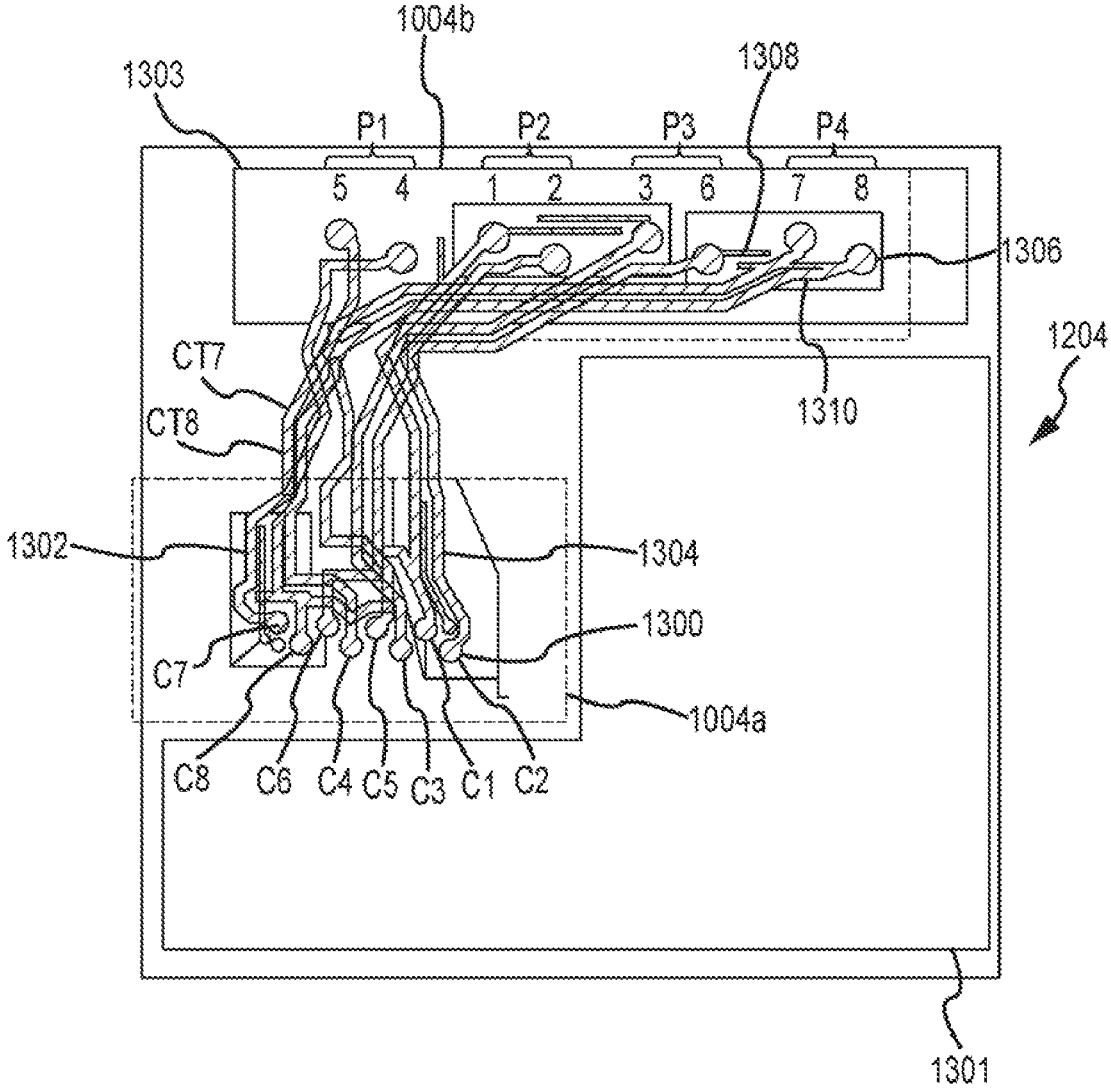
FIGS. 12A-12C illustrate the physical layout of a portion of the common rigid printed circuit board of FIG. 11 showing the dual modal alien crosstalk compensation stage for one of the communications outlets according to one embodiment of the present invention.
Figure 12B:
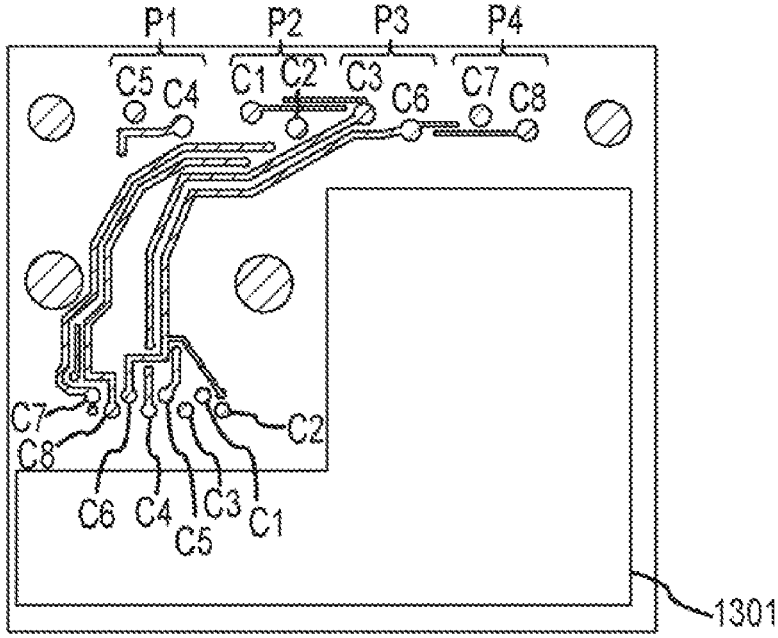
Figure 12C:
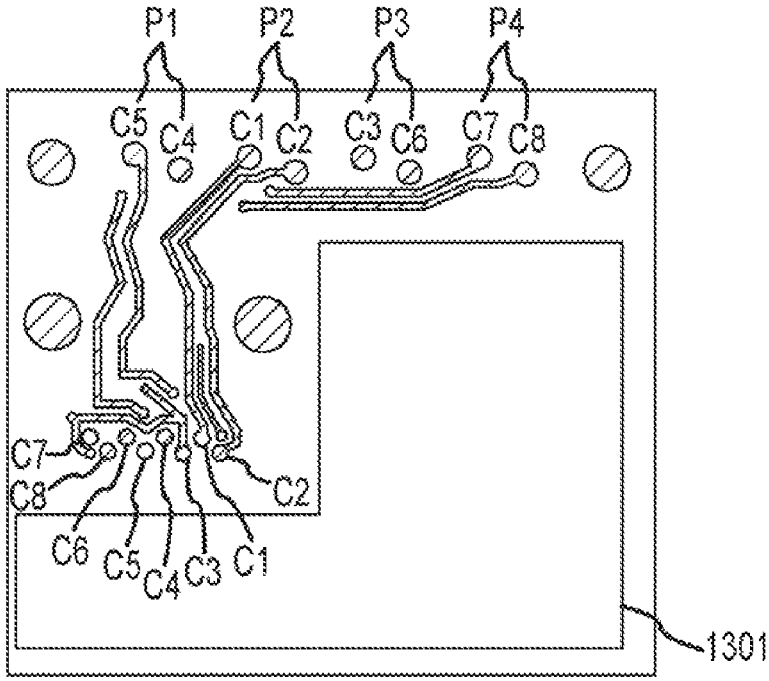

FIGS. 12A-12C illustrate the physical layout of a portion of the common printed circuit board 1204 showing the dual modal alien crosstalk compensation stage 1002 for one of the communications outlets 1202 of FIG. 11 according to one embodiment of the present invention. The outline of where a housing of a corresponding one of the communications outlets 1202 would be positioned on the common printed circuit board 1204 is labeled 1301 in the figure. The same is shown for the outline 1303 of where the housing of the corresponding wire termination contacts 1206 would be positioned on the common printed circuit board 1204. FIG. 12A shows conductive traces formed on both sides of the circuit board 1204, while FIG. 12B shows the conductive traces formed on the first side 1204*a* (FIG. 11) of the board and FIG. 12C shows the conductive traces formed on the second side 1204*b* (FIG. 11) of the board.

The dual modal alien crosstalk compensation stage 1002 includes the first modal alien crosstalk compensation stage 1004*a* including the capacitors CMC37, CMC38, CMC16, CMC26 as previously discussed with reference to FIG. 9. FIG. 12A shows conductive traces formed on both sides of the common printed circuit board 1204. Through holes 1300 towards the bottom of the board 1204 are formed to receive the fixed ends 1008 of the tines T (see FIG. 9), with only the through hole 1300 that is part of conductor C2 and that receives the tine T2 being labeled. A conductive trace 1302 is positioned between conductive traces CT7 and CT8 and is connected to conductor C3 to form the capacitors CMC37 and CMC38 of the first modal alien crosstalk compensation stage 1004*a*. Similarly, a conductive trace 1304 is positioned between conductive traces CT1 and CT2 and is connected to conductor C6 to form the capacitors CMC16 and CMC26 of the first modal alien crosstalk compensation stage 1004*a*. As seen in the FIG. 12A, these capacitors CMC of the first modal alien crosstalk compensation stage 1004*a* are physically formed proximate the through holes 1300 that receive the fixed ends 1008 of the tines T.

The dual modal alien crosstalk compensation stage 1002 further includes the second modal alien crosstalk compensation stage 1004*b* including the capacitors CMCR13, CMCR23, CMCR67, and CMCR68 as previously discussed with reference to FIG. 9. Through holes 1306 (FIG. 12) towards the top of the board 1204 (FIG. 11) are formed to receive the conductive portions of the corresponding wire termination contacts 1206 (see FIG. 11), with only the through hole 1306 that is part of conductor C8 and being labeled. A first conductive trace 1308 extends from conductive trace CT6 towards conductive trace CT7 to form the capacitor CMCR67 of the second modal alien crosstalk compensation stage 1004*b*. Similarly, a second conductive trace 1310 extends from conductive trace CT8 towards the first conductive trace 1308 and conductive trace CT6 to form the capacitor CMCR68 of the second modal alien crosstalk compensation stage 1004*b*. As seen in FIGS. 9, 11 and 12, these capacitors CMCR of the second modal alien crosstalk compensation stage 1004*b* are physically formed proximate the through holes 1306 that receive the conductive portions of the corresponding wire termination contacts 1206.

The independent modal capacitors CMC37, CMC38, CMC16, CMC26 and CMCR13, CMCR23, CMCR67, CMCR68 may be formed in a variety of different suitable ways on either the rigid printed circuit board 300 (FIG. 4), flexible printed circuit board 800 (FIGS. 8A and 8B), rigid printed circuit board 1010 (FIG. 9), and common rigid printed circuit board 1204 (FIGS. 11 and 12). For example, these modal capacitors may be formed through inter-digital traces formed on these circuit boards, through inter-layer pads on the circuit boards, through lumped capacitive elements, and in other suitable ways, as will be appreciated by those skilled in the art. The modal capacitors CMC and CMCR are termed "independent" modal capacitors because these capacitive elements are separate and distinct components from the tines T of the outlets 200, 1000, and 1202 according to the various described embodiments of the present invention. Also, in other embodiments of the present invention, the modal capacitors CMC and CMCR may be located at different points along the tines T or along the conductive traces CT on the rigid circuit boards of the various embodiments. In other embodiments, the outlets 200, 1000, and 1202 include additional tines T and corresponding conductive traces and wire termination contacts.

Figure 13:
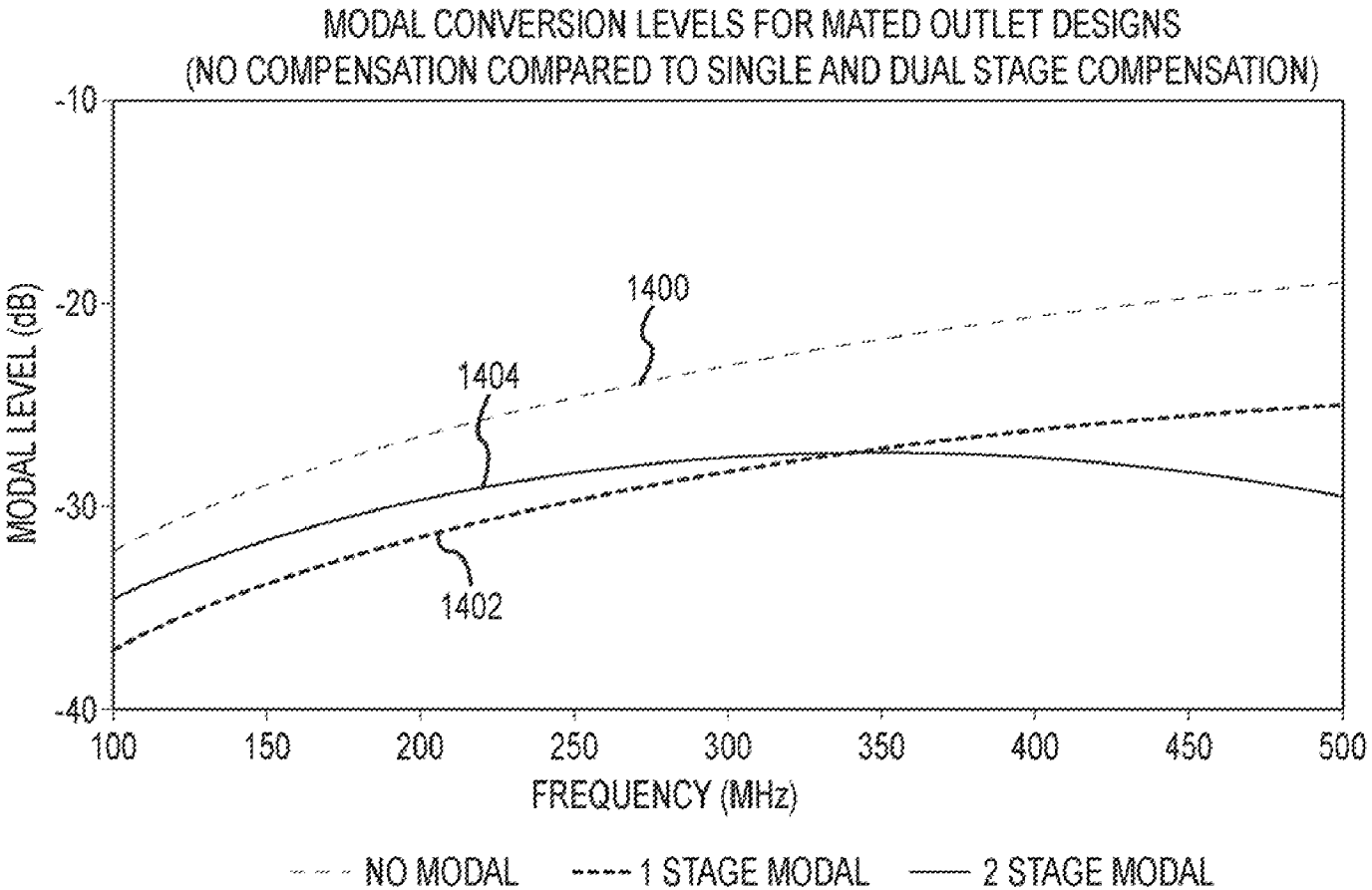
FIG. 13 is a graph illustrating the amount of signal that is converted from differential mode on pair 3 to common mode on pairs 2 and 4 for various mated outlet designs.

FIG. 13 is a graph illustrating the amount of signal in decibels which is converted from differential mode on pair P3 to common mode signals on pairs P2 and P4 (modal conversion) for various mated outlet designs. The level of this signal is considered by those skilled in the art to be proportional to the potential amount of modal alien crosstalk that could occur between communications channels in which the outlets are utilized. This modal conversion signal in decibels is displayed along the vertical axis and frequency along the horizontal axis for embodiments of mated communication outlets having a single modal alien crosstalk compensation stage, such as the outlet 200 of FIG. 4, and for mated outlets having dual modal alien crosstalk compensation stages, such as the mated outlets 1000 of FIG. 9. The line 1400 in the graph shows the modal conversion of a conventional mated outlet which has no compensation for modal alien crosstalk. The line 1402 in the graph shows the modal conversion of an outlet having only the single modal alien crosstalk compensation stage 202 in the outlet 200 of FIG. 4. As seen in the graph, over the entire frequency range this outlet has less modal conversion than outlets without any such compensation. The line 1404 in the graph shows the modal conversion of an outlet including dual modal alien crosstalk compensation stages such as in the outlets 1000 and 1202. At higher frequencies an outlet that incorporates dual stage modal alien crosstalk compensation, as represented by line 1404, has less modal conversion than an outlet with single stage modal alien crosstalk compensation, as represented by line 1402.

The amount of modal conversion observed is proportional to the potential amount of modal alien crosstalk that could occur between channels in which the outlets are utilized. Thus the outlets with either single or dual stage modal alien crosstalk compensation will provide for lower levels of modal alien crosstalk in the channel compared to the performance of conventional outlets with no such compensation. Furthermore, the outlet having dual stage modal alien compensation will provide lower levels of modal alien crosstalk than does the outlet having only single stage modal alien compensation at high frequency.

Communications outlets 200, 1000, 1202, and outlets according to other embodiments of the present invention, can be included in a variety of different types of electronic systems, such as the communications network 100 of FIG. 1. The network 100 would typically include many communications channels 101, each channel interconnecting components such as the computer system 108 and network switch 122. Moreover, the computer system 108 and network switch 122 are just examples of components that can be connected to communications channels 101. A wide variety of electronic subsystems may be connected to respective communications channels 101 in lieu of the computer system 108 and switch 122. For example, the first electronic subsystem 108 could be a local area network including a plurality of computers.

Even though various embodiments and advantages of the present invention have been set forth in the foregoing description, the above disclosure is illustrative only, and changes may be made in detail and yet remain within the broad principles of the present invention. Therefore, the present invention is to be limited only by the appended claims. Furthermore, in the present description certain details have been set forth in conjunction with the described embodiments of the present invention to provide a sufficient understanding of the invention. One skilled in the art will appreciate, however, that the invention itself and various aspects thereof may be practiced without these particular details. Furthermore, one skilled in the art will appreciate that the sample embodiments described do not limit the scope of the present invention, and will also understand that various modifications, equivalents, and combinations of the disclosed embodiments and components of such embodiments are within the scope of the present invention. Embodiments including fewer than all the components of any of the respective described embodiments may also be within the scope of the present invention although not expressly described in detail herein. Finally, the operation or structure of well known components and/or processes has not been shown or described in detail herein to avoid unnecessarily obscuring the present invention.

What is claimed is:

1. A communications outlet including eight conductive paths, each conductive path including a corresponding outlet tine and the outlet tines being positioned adjacent one another and defining four pairs of outlet tines, the fourth and fifth outlet tines defining a first pair, the first and second outlet tines defining a second pair, the third and sixth outlet tines defining a third pair, and the seventh and eighth outlet tines defining a fourth pair, each outlet tine having a free end near which a plug contact is adapted to touch the outlet tine and each outlet tine having a fixed end coupled through a corresponding conductive trace to a corresponding wire terminating contact, the communications outlet comprising a first modal alien crosstalk compensation stage connected to the conductive paths associated with the second, third, and fourth pairs, the first modal alien crosstalk compensation stage including independent capacitive components operably responsive to differential signals on the third pair to introduce common mode signals onto the second and fourth pairs that have the opposite polarity of common mode signals on the second and fourth pairs at points where the plug contact touches the outlet tines;

a second modal alien crosstalk compensation stage coupled to selected ones of the conductive paths, the second modal alien crosstalk compensation stage including independent capacitive components operably responsive to differential signals on the third pair to introduce common mode signals onto the second and fourth pairs that have the same polarity as common mode signals on the second and fourth pairs introduced in the plug contacts; and wherein the independent capacitive components of the second modal alien crosstalk compensation stage comprise:

a first capacitance coupled between the conductive path of the third outlet tine and the conductive path of the second outlet tine;

a second capacitance coupled between the conductive path of the third outlet tine and the conductive path of the first outlet tine;

a third capacitance coupled between the conductive path of the sixth outlet tine and the conductive path of the seventh outlet tine; and a fourth capacitance coupled between the conductive path of the sixth outlet tine and the conductive path of the eighth outlet tine.

2. The communications outlet of claim 1 wherein the first modal alien crosstalk compensation stage is connected to the outlet tine in each of the corresponding conductive paths.

3. The communications outlet of claim 1 wherein each wire termination contact comprises an insulation displacement connector.

4. The communications outlet of claim 1 wherein the independent capacitive components of the first modal alien crosstalk compensation stage comprise:

a fifth capacitance coupled between the conductive path of the third outlet tine and the conductive path of the seventh outlet tine;

a sixth capacitance coupled between the conductive path of the third outlet tine and the conductive path of the eighth outlet tine;

a seventh capacitance coupled between the conductive path of the sixth outlet tine and the conductive path of the second outlet tine; and an eighth capacitance coupled between the conductive path of the sixth outlet tine and the conductive path of the first outlet tine.

5. The communications outlet of claim 4 further comprising a flexible printed circuit board coupled to the outlet tines near where the plug contacts touch the outlet tines, and wherein the fifth, sixth, seventh, and eighth capacitances are formed on the flexible printed circuit board.

6. The communications outlet of claim 4 further comprising a rigid printed circuit board, the fixed end of each outlet tine being connected to the rigid printed circuit board and the rigid printed circuit board including the conductive traces through which the fixed end of each outlet tine is connected to a corresponding one of the wire terminating contacts.

7. The communications outlet of claim 6 wherein the fifth, sixth, seventh, and eighth capacitances are formed through inter-digital traces formed on the rigid printed circuit board, the inter-digital traces being positioned relative to the conductive traces to form the desired fifth, sixth, seventh, and eighth capacitances.

8. The communications outlet of claim 6 wherein the fifth, sixth, seventh, and eighth capacitances are formed through inter-layer pads formed on the rigid printed circuit board, the inter-layer pads being positioned relative to the conductive traces to form the desired first, second, third, and fourth capacitances.

9. The communications outlet of claim 6 wherein the fifth, sixth, seventh, and eighth capacitances are formed through lumped capacitors mounted on the rigid printed circuit board and connected to the appropriate conductive traces.

10. The communications outlet of claim 1 further comprising:

a rigid printed circuit board including, a plurality of outlet tines through holes into which the fixed ends of the outlet tines are inserted to attach the outlet tines to the rigid printed circuit board, a plurality of wire terminating contact through holes into which the wire terminating contacts are inserted to attach each wire terminating contact to the rigid printed circuit board, and wherein the conductive traces are formed on the rigid printed circuit board, the conductive traces interconnecting the outlet tine through holes and wire terminating contact through holes.

11. The communications outlet of claim 10, wherein the independent capacitive components of the first modal alien crosstalk stage are formed on the rigid printed circuit board near the outlet tine through holes; and wherein the independent capacitive components of the second modal alien crosstalk stage are formed on the rigid printed circuit board near the wire termination contact through holes.

12. The communications outlet of claim 10 further comprising:

a flexible printed circuit board attached to the outlet tines near where the plug tines contact the outlet tines, and wherein the independent capacitive components of the first modal alien crosstalk stage are formed on the flexible printed circuit board; and wherein the independent capacitive components of the second modal alien crosstalk stage are formed on the rigid printed circuit board near the wire termination contact through holes.

13. The communications outlet of claim 12, wherein the wire termination contact through holes are arranged to provide capacitive coupling between the wire termination contact through holes and/or the conductive traces to thereby form the independent capacitive components of the second modal alien crosstalk compensation stage.

14. The communications outlet of claim 12 further comprising a first internal crosstalk compensation stage formed on the flexible printed circuit board, the first internal crosstalk compensation stage being coupled to selected ones of the outlet tines near the free ends of the tines where the plug tines touch the outlet tines.

15. An electronic system, comprising:

a first electronic subsystem;

a first plurality of communication cables coupled to the first electronic subsystem, each cable including a corresponding communications plug;

a plurality of communications outlets, each communications outlet adapted to receive a corresponding one of the communications plugs, at least some of the communications outlets including eight conductive paths with each conductive path including a corresponding outlet tine, the outlet tines being positioned adjacent one another and defining four pairs of outlet tines, the fourth and fifth outlet tines defining a first pair, the first and second outlet tines defining a second pair, the third and sixth outlet tines defining a third pair, and the seventh and eighth outlet tines defining a fourth pair, each outlet tine having a free end near which a plug contact is adapted to touch the outlet tine and each outlet tine having a fixed end coupled through a corresponding conductive trace to a corresponding wire termination contact, the communications outlet comprising a first modal alien crosstalk compensation stage connected to the conductive paths associated with the second, third, and fourth pairs, the first modal alien crosstalk compensation stage including independent capacitive components operably responsive to differential signals on the third pair to introduce common mode signals onto the second and fourth pairs that have the opposite polarity as common mode signals on the second and fourth pairs at points where the plug contacts touch the outlet tines;

a second modal alien crosstalk compensation stage coupled to selected ones of the conductive paths, the second modal alien crosstalk compensation stage including independent capacitive components operably responsive to differential signals on the third pair to introduce common mode signals onto the second and fourth pairs that have the same polarity as common mode signals on the second and fourth pairs introduced in the plug contacts; and wherein the independent capacitive components of the second modal alien crosstalk compensation stage comprise:

a first capacitance coupled between the conductive path of the third outlet tine and the conductive path of the second outlet tine;

a second capacitance coupled between the conductive path of the third outlet tine and the conductive path of the first outlet tine;

a third capacitance coupled between the conductive path of the sixth outlet tine and the conductive path of the seventh outlet tine; and a fourth capacitance coupled between the conductive path of the sixth outlet tine and the conductive path of the eighth outlet tine;

a second plurality of communication cables coupled to the wire termination contacts of the plurality of communications outlets; and a second electronic subsystem coupled to the second plurality of communication cables.

16. The electronic system of claim 15 wherein the first and second electronic subsystems each comprise computer networks.

17. The electronic system of claim 15 wherein at least some of the communications outlets comprise RJ-45 outlets.

18. The electronic system of claim 15 wherein the first modal alien crosstalk compensation stage is connected to the outlet tine in each of the corresponding conductive paths.

19. The electronic system of claim 15 wherein each wire termination contact comprises an insulation displacement connector.

20. The electronic system of claim 15 wherein the independent capacitive components of the first modal alien crosstalk compensation stage comprise:

a fifth capacitance coupled between the conductive path of the third outlet tine and the conductive path of the seventh outlet tine;

a sixth capacitance coupled between the conductive path of the third outlet tine and the conductive path of the eighth outlet tine;

a seventh capacitance coupled between the conductive path of the sixth outlet tine and the conductive path of the second outlet tine; and an eighth capacitance coupled between the conductive path of the sixth outlet tine and the conductive path of the first outlet tine.

21. The communications outlet of claim 20 further comprising a flexible printed circuit board coupled to the outlet tines near where the plug contacts touch the outlet tines, and wherein the fifth, sixth, seventh, and eighth capacitances are formed on the flexible printed circuit board.

22. The electronic system of claim 20 further comprising a rigid printed circuit board, the fixed end of each outlet tine being connected to the rigid printed circuit board and the rigid printed circuit board including the conductive traces through which the fixed end of each outlet tine is connected to a corresponding one of the wire terminating contacts.

23. The electronic system of claim 22 wherein the fifth, sixth, seventh, and eighth capacitances are formed through inter-digital traces formed on the rigid printed circuit board, the inter-digital traces being positioned relative to the conductive traces to form the desired fifth, sixth, seventh, and eighth capacitances.

24. The electronic system of claim 22 wherein the fifth, sixth, seventh, and eighth capacitances are formed through inter-layer pads formed on the rigid printed circuit board, the inter-layer pads being positioned relative to the conductive traces to form the desired first, second, third, and fourth capacitances.

25. The electronic system of claim 22 wherein the fifth, sixth, seventh, and eighth capacitances are formed through lumped capacitors mounted on the rigid printed circuit board and connected to the appropriate conductive traces.

* * * * *